US009993699B2

(12) United States Patent
Larson

(10) Patent No.: US 9,993,699 B2
(45) Date of Patent: Jun. 12, 2018

(54) GOLF CLUB HEAD OR OTHER BALL STRIKING DEVICE HAVING FACE DEFORMATION LIMITING MEMBER

(71) Applicant: Karsten Manufacturing Corporation, Pheonix, AZ (US)

(72) Inventor: Eric A. Larson, Ft. Worth, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days. days.

(21) Appl. No.: 13/907,439

(22) Filed: May 31, 2013

(65) Prior Publication Data

US 2013/0324297 A1 Dec. 5, 2013

Related U.S. Application Data

(60) Provisional application No. 61/653,873, filed on May 31, 2012.

(51) Int. Cl.
*A63B 53/04* (2015.01)
*A63B 60/54* (2015.01)

(52) U.S. Cl.
CPC ..... *A63B 53/04* (2013.01); *A63B 53/047* (2013.01); *A63B 53/0466* (2013.01); *A63B 60/54* (2015.10); *A63B 2053/042* (2013.01); *A63B 2053/045* (2013.01); *A63B 2053/0416* (2013.01); *A63B 2053/0433* (2013.01); *A63B 2053/0437* (2013.01)

(58) Field of Classification Search
CPC ..... A63B 2053/0416; A63B 2053/0454
USPC ..... 473/325, 329
See application file for complete search history.

(56) References Cited

U.S. PATENT DOCUMENTS 5,299,807 A * 4/1994 Hutin ..... 473/329
5,431,396 A * 7/1995 Shieh ..... 473/329
5,499,814 A * 3/1996 Lu ..... A63B 53/04 473/329
5,779,560 A * 7/1998 Buck et al. ..... 473/342
(Continued)

FOREIGN PATENT DOCUMENTS

JP H08150230 A 6/1996
JP 2001054598 A 2/2001
(Continued)

OTHER PUBLICATIONS

ISR & WO dated Nov. 6, 2013, from PCT Application No. PCT/US2013/04353.

*Primary Examiner* — William Pierce

(57) ABSTRACT

A ball striking device, such as a golf club head, includes a face having a ball striking surface, an inner surface opposite the ball striking surface, and a body connected to the face and extending rearward from the face. The head has a deformation limiting member located behind the face and having an end spaced a distance from the inner surface of the face. The face and the deformation limiting member are adapted such that an impact of the ball on the ball striking surface causes deformation of the face toward the deformation limiting member. When the deformation of the face is sufficient to cause the inner surface of the face to engage the deformation limiting member, the deformation limiting member exerts a force on the face to resist further deformation of the face.

22 Claims, 18 Drawing Sheets

(56) References Cited

U.S. PATENT DOCUMENTS

| | | | | |
|---|---|---|---|---|
| 5,863,261 | A * | 1/1999 | Eggiman | A63B 53/04 473/329 |
| 5,888,148 | A * | 3/1999 | Allen | 473/290 |
| 5,931,746 | A * | 8/1999 | Soong | 473/329 |
| 5,993,329 | A * | 11/1999 | Shieh | 473/329 |
| 6,042,486 | A * | 3/2000 | Gallagher | 473/329 |
| 6,165,081 | A * | 12/2000 | Chou | 473/329 |
| 6,193,614 | B1 * | 2/2001 | Sasamoto et al. | 473/329 |
| 6,299,547 | B1 * | 10/2001 | Kosmatka | 473/329 |
| 6,354,956 | B1 * | 3/2002 | Doong | A63B 53/0466 473/219 |
| 6,354,961 | B1 * | 3/2002 | Allen | 473/329 |
| 6,368,231 | B1 * | 4/2002 | Chen | 473/329 |
| 6,616,546 | B2 * | 9/2003 | Cho | A63B 53/04 473/329 |
| 6,695,715 | B1 * | 2/2004 | Chikaraishi | 473/329 |
| 6,979,270 | B1 * | 12/2005 | Allen | 473/290 |
| 7,591,735 | B2 * | 9/2009 | Matsunaga et al. | 473/329 |
| 7,597,633 | B2 * | 10/2009 | Shimazaki et al. | 473/329 |
| 7,611,423 | B2 * | 11/2009 | Matsunaga et al. | 473/329 |
| 8,257,195 | B1 * | 9/2012 | Erickson | 473/329 |
| 8,821,313 | B1 * | 9/2014 | Dawson et al. | 473/329 |
| 8,888,607 | B2 * | 11/2014 | Harbert | A63B 53/04 473/307 |
| 2002/0098909 | A1 * | 7/2002 | Cho | 473/329 |
| 2005/0075192 | A1 | 4/2005 | Han | |
| 2007/0026962 | A1 * | 2/2007 | Galloway et al. | 473/329 |
| 2010/0323812 | A1 * | 12/2010 | Boyd et al. | 473/329 |
| 2013/0331202 | A1 * | 12/2013 | Boyd et al. | 473/329 |

FOREIGN PATENT DOCUMENTS

| | | | |
|---|---|---|---|
| JP | 2004081343 | A | 3/2004 |
| JP | 2004141267 | A | 5/2004 |
| WO | 2010126729 | | 4/2010 |

* cited by examiner

GOLF CLUB HEAD OR OTHER BALL STRIKING DEVICE HAVING FACE DEFORMATION LIMITING MEMBER

CROSS-REFERENCE TO RELATED APPLICATION

This application is a non-provisional of and claims priority to U.S. Patent Application No. 61/653,873, filed May 31, 2012, which is incorporated herein by reference in its entirety and made part hereof.

TECHNICAL FIELD

The invention relates generally to ball striking devices, such as golf clubs and heads. Certain aspects of this invention relate to golf clubs and golf club heads having a deformation limiting member that limits deformation of the face.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club should meet the golf ball square (or substantially square) to the desired target path. Moreover, the golf club should meet the golf ball at or close to a desired location on the club head face (i.e., on or near a "desired" or "optimal" ball contact location) to reliably fly straight, in the desired direction, and for a desired distance. Off-center hits that deviate from squared contact and/or are located away from the club's desired ball contact location may tend to "twist" the club face when it contacts the ball, thereby sending the ball in the wrong direction, often imparting undesired hook or slice spin, and/or robbing the shot of distance. Thus, when the club face is not square at the point of engagement, the golf ball may fly in an unintended direction and/or may follow a route that curves left or right, ball flights that are often referred to as "pulls," "pushes," "draws," "fades," "hooks," or "slices," or may exhibit more boring or climbing trajectories.

The energy and velocity transferred to the ball by a golf club may be related, at least in part, to the flexibility of the club face at the point of contact, and can be expressed using a measurement called "coefficient of restitution" (or "COR"). The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at the center of the face. In one example, the area of highest response may have a COR that is up to the prevailing USGA limit (e.g. 0.83), which limit may change over time. However, because golf clubs are typically designed to contact the ball at or around the center of the face, off-center hits may result in less energy being transferred to the ball, decreasing the distance of the shot. The COR at a specific location on the club head can be related to the modulus of elasticity at the impact location, as well as the modulus of other areas of the face spaced away from the impact location. Similarly, the contact time between the ball and the face during impact can affect energy transfer. Generally, a more flexible (lower modulus) face will produce higher contact times, resulting in greater energy transfer. The contact time is currently limited by the USGA at 257 ns, according to the USGA Characteristic Time (CT) test. Club head features that can increase the energy transferred to a ball during impact can be advantageous.

It is common for professional golfers and other experienced golfers to have higher swing speeds (i.e., the speed of the club head at or around impact with the ball) than less experienced golfers. Many club heads are designed to deliver optimal performance at higher swing speeds, and may offer less optimal performance at lower swing speeds. Accordingly, club head features that can improve performance at lower swing speeds and can allow players having low swing speeds to achieve greater ball speeds can prove to be advantageous for use by less experienced golfers. Additionally, club head features that can improve performance at lower swing speeds, while not impeding the ball speed achieved at higher swing speeds can prove to be advantageous.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face having a ball striking surface configured for striking a ball and an inner surface opposite the ball striking surface, as well as a body connected to the face and extending rearward from the face. The head has a deformation limiting member located behind the face and having an end spaced a distance from the inner surface of the face. The face and the deformation limiting member are adapted such that an impact of the ball on the ball striking surface causes deformation of the face toward the deformation limiting member. When the deformation of the face is sufficient to cause the inner surface of the face to engage the deformation limiting member, the deformation limiting member exerts a force on the face to resist further deformation of the face.

According to one aspect, the face is adapted such that impacts of the ball on the face below a threshold impact velocity do not deform the face sufficiently to engage the deformation limiting member, and impacts of the ball on the face above the threshold impact velocity deform the face sufficiently to engage the deformation limiting member.

According to another aspect, the deformation limiting member extends from an inner surface of the body toward the inner surface of the face.

According to a further aspect, the face includes a face plate connected to a body member forming the body. The body member has a mounting portion, such that the face plate is connected to the mounting portion. In one embodiment, the body member has an opening at a front end thereof, and the mounting portion is positioned around at least a portion of the opening and forms a recessed platform around at least a portion of the opening, such that a peripheral edge of the face plate contacts the recessed platform to connect the face plate to the mounting portion. In another embodiment, the deformation limiting member is connected to the mounting portion and extends from the mounting portion toward the inner surface of the face. In a further embodiment, the mounting portion is connected to the face plate at top and bottom sides of the face plate, with first and second portions of the deformation limiting member extending from the mounting portion at the top and bottom sides, respectively, toward the inner surface of the face.

According to yet another aspect, the face includes a face plate connected to a body member forming the body. The body member has an opening receiving the face plate therein, and the deformation limiting member includes a flange extending inwardly from an inner surface of the body member around at least a portion of the opening.

According to a still further aspect, the deformation limiting member includes a plurality of braces extending inwardly from inner surfaces of the body, with each brace having an end spaced a distance from the inner surface of the face.

Additional aspects of the invention relate to a wood-type golf club head that includes a face having a ball striking surface adapted to impact a golf ball and an inner surface opposite the ball striking surface, and a wood-type body connected to the face and extending rearward from the face, such that the face and the body define an interior cavity and an interior surface surrounding the cavity and further define a volume of at least 400 cc. The head includes a deformation limiting member located behind the face and having a first portion extending from a fixed end at the interior surface proximate a first of the peripheral edges of the face, toward a center of the face, and a second portion extending from a fixed end at the interior surface proximate a second of the peripheral edges of the face, toward the center of the face. The first and second portions of the deformation limiting member each having a free end spaced a distance from the inner surface of the face. The face and the deformation limiting member are adapted such that an impact of the ball on the ball striking surface causes deformation of the face toward the free ends of the first and second portions of the deformation limiting member. When the deformation of the face is sufficient to cause the inner surface of the face to engage at least one of the free ends of the deformation limiting member, the deformation limiting member exerts a force on the face to resist further deformation of the face. Various aspects described above can be incorporated into the head as well.

Further aspects of the invention relate to a golf club head that includes a face member connected to a body member. The face member forms a face having a ball striking surface adapted to impact a ball and an inner surface opposite the ball striking surface. The body member has a front end with an opening receiving the face member therein and a rear end extending rearwardly from the front end to form a body extending rearward from the face. A deformation limiting member extends inwardly from an inner surface of the body member and has an end spaced a distance from the inner surface of the face. The face member and the deformation limiting member are adapted such that an impact of the ball on the ball striking surface causes deformation of the face toward the deformation limiting member. When the deformation of the face is sufficient to cause the inner surface of the face to engage the deformation limiting member, the deformation limiting member exerts a force on the face to resist further deformation of the face.

According to one aspect, the face member is adapted such that impacts of the ball on the face below a threshold impact velocity do not deform the face sufficiently to engage the deformation limiting member, and impacts of the ball on the face above the threshold impact velocity deform the face sufficiently to engage the deformation limiting member.

According to another aspect, the deformation limiting member extends from the inner surface of the body toward a center of the face.

According to a further aspect, the body member has a mounting portion positioned around at least a portion of the opening, wherein the face member is connected to the mounting portion. In one embodiment, the mounting portion forms a recessed platform around at least a portion of the opening, and a peripheral edge of the face member contacts the recessed platform to connect the face plate to the mounting portion. According to another embodiment, the deformation limiting member is connected to the mounting portion and extends from the mounting portion toward the inner surface of the face. In a further embodiment, the mounting portion is connected to the face member at top and bottom sides of the face member, and first and second portions of the deformation limiting member extend from the mounting portion at the top and bottom sides, respectively, toward the inner surface of the face.

According to yet another aspect, the deformation limiting member comprises a flange extending inwardly from the inner surface of the body member around at least a portion of the opening.

Still further aspects of the invention relate to wood-type golf club head that includes a face member and a body member connected to the face member. The face member has a ball striking surface adapted to impact a golf ball and an inner surface opposite the ball striking surface, with the face member being defined by peripheral edges. The body member has a front end with an opening receiving the face member therein and a rear end extending rearwardly from the front end to form a wood-type body extending rearward from the face. The face member and the body member define an interior cavity and an interior surface surrounding the cavity and define a volume of at least 400 cc. The body member further has a mounting portion forming a platform around at least a portion of the opening, where the platform is recessed from the front end of the body member and the peripheral edges of the face plate contact the platform to connect the face plate to the mounting portion. The head also includes deformation limiting member having a fixed end connected to the mounting portion, such that the deformation limiting member extends from the mounting portion toward a center of the face and has a free end spaced a distance from the inner surface of the face. The face member and the deformation limiting member are adapted such that an impact of the ball on the ball striking surface causes deformation of the face toward the deformation limiting member. When the deformation of the face is sufficient to cause the inner surface of the face to engage the deformation limiting member, the deformation limiting member exerts a force on the face to resist further deformation of the face. Various aspects described above can be incorporated into the head as well.

According to one aspect, the mounting portion is connected to the face member at top and bottom sides of the face member, where a first portion of the deformation limiting member extends from the mounting portion at the top side toward the inner surface of the face and a second portion of the deformation limiting member extends from the mounting portion at the bottom side toward the inner surface of the face. In one embodiment, the deformation limiting member includes a flange extending inwardly from the mounting portion around at least a top portion and a bottom portion of the opening, where the flange defines the first portion and the second portion of the deformation limiting member.

Other aspects of the invention relate to a method that includes selecting at least one face member and/or at least one body member, as described above, from a plurality of such members. The face member and body member can then be assembled to produce a head.

Still other aspects of the invention relate to golf clubs that include a golf club head as described above and a shaft connected to the head, or a set of golf clubs including at least one golf club having a head as described above.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

Figure 1:
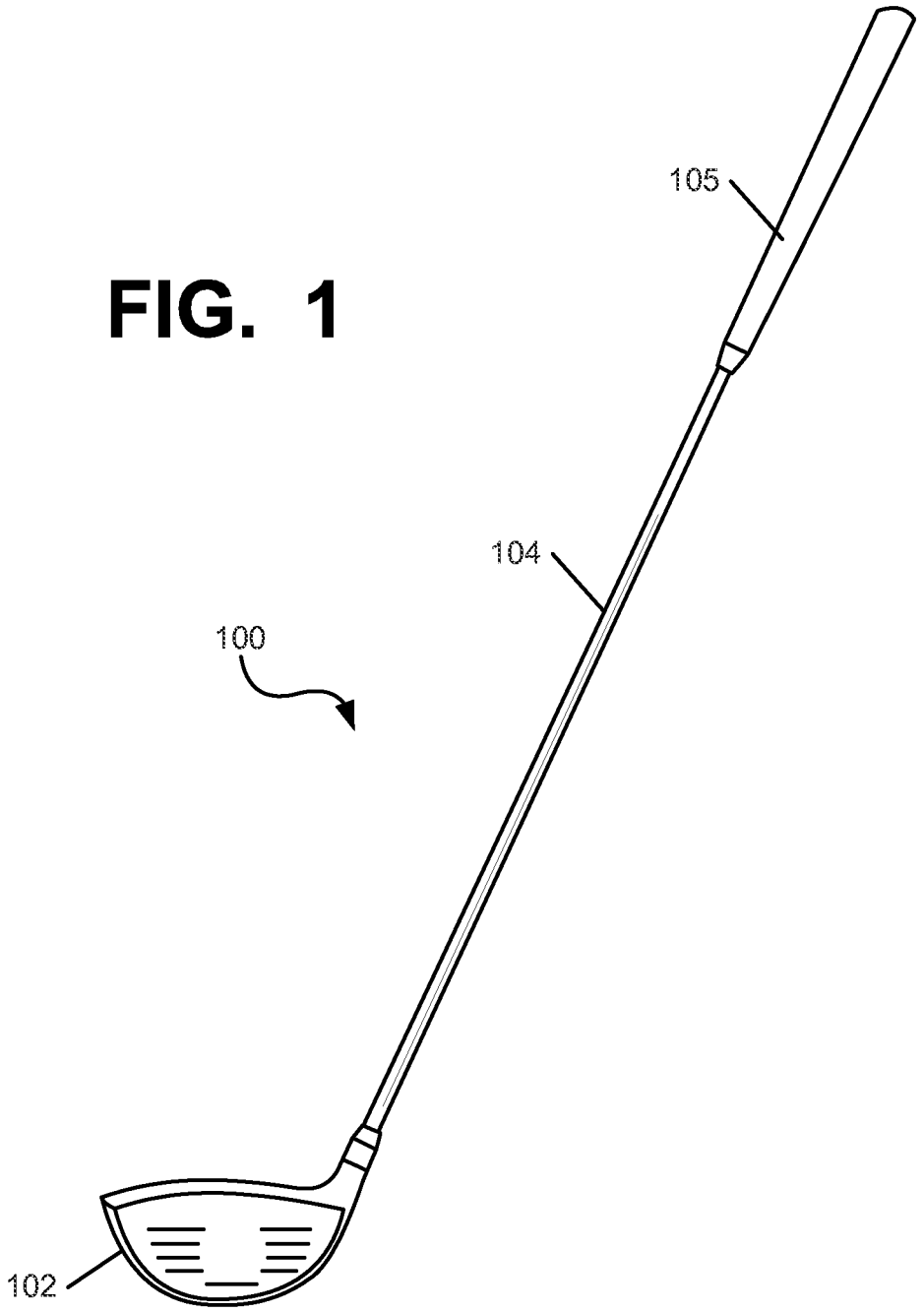
FIG. 1 is a front view of an illustrative embodiment of a wood-type ball striking device according to aspects of the present invention.
Figure 2:
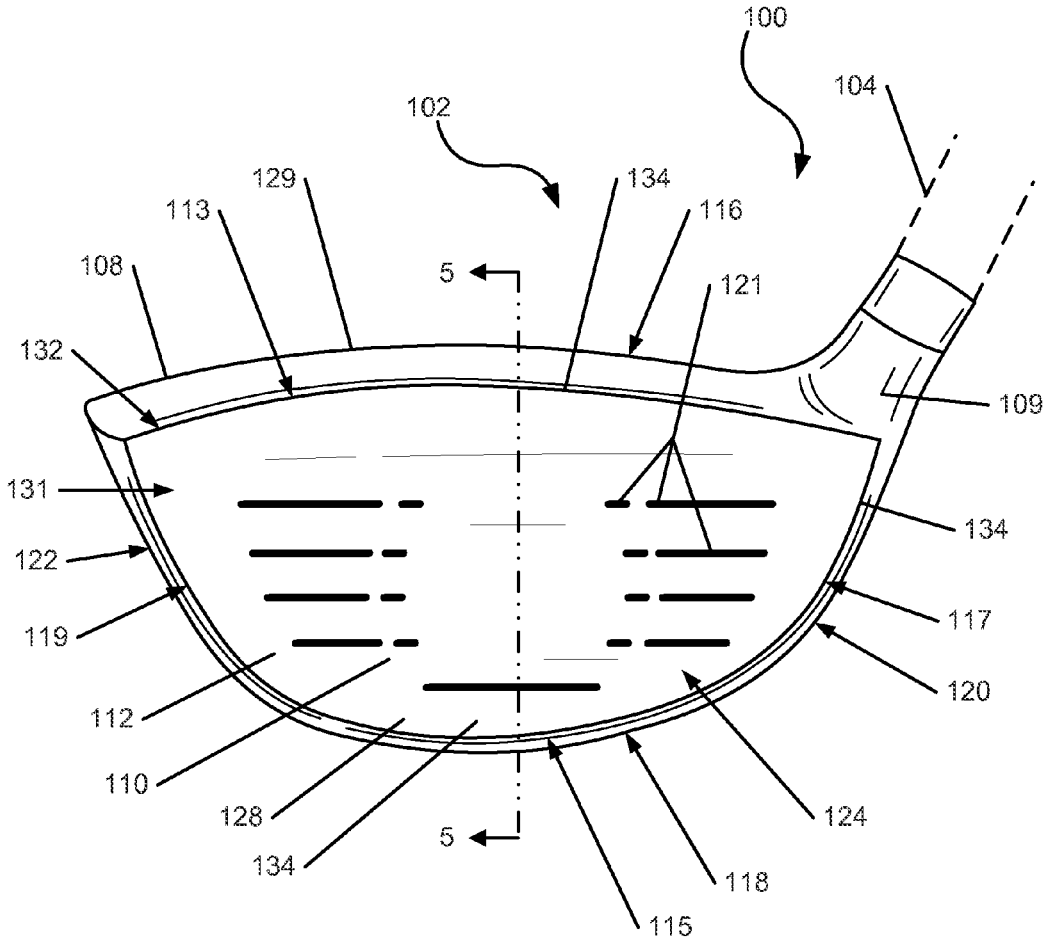
FIG. 2 is a front view of a head of the ball striking device of FIG. 1.
Figure 3:
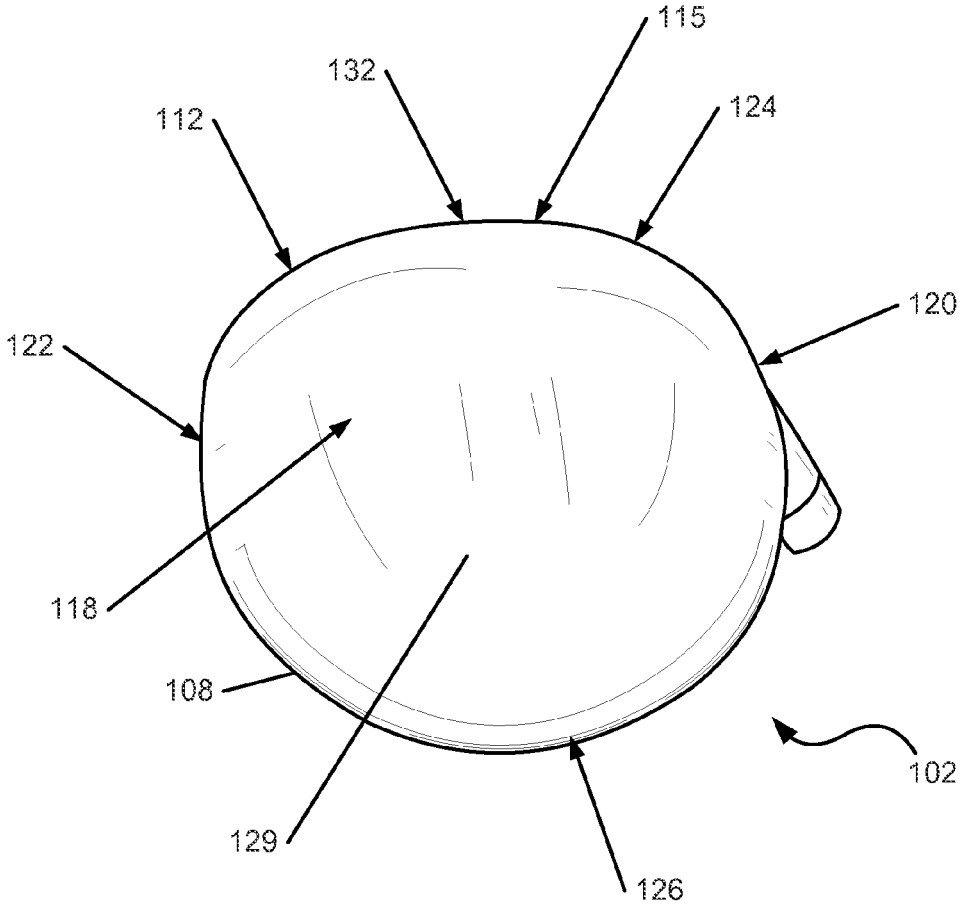
FIG. 3 is a bottom view of the head of FIG. 2.
Figure 4:
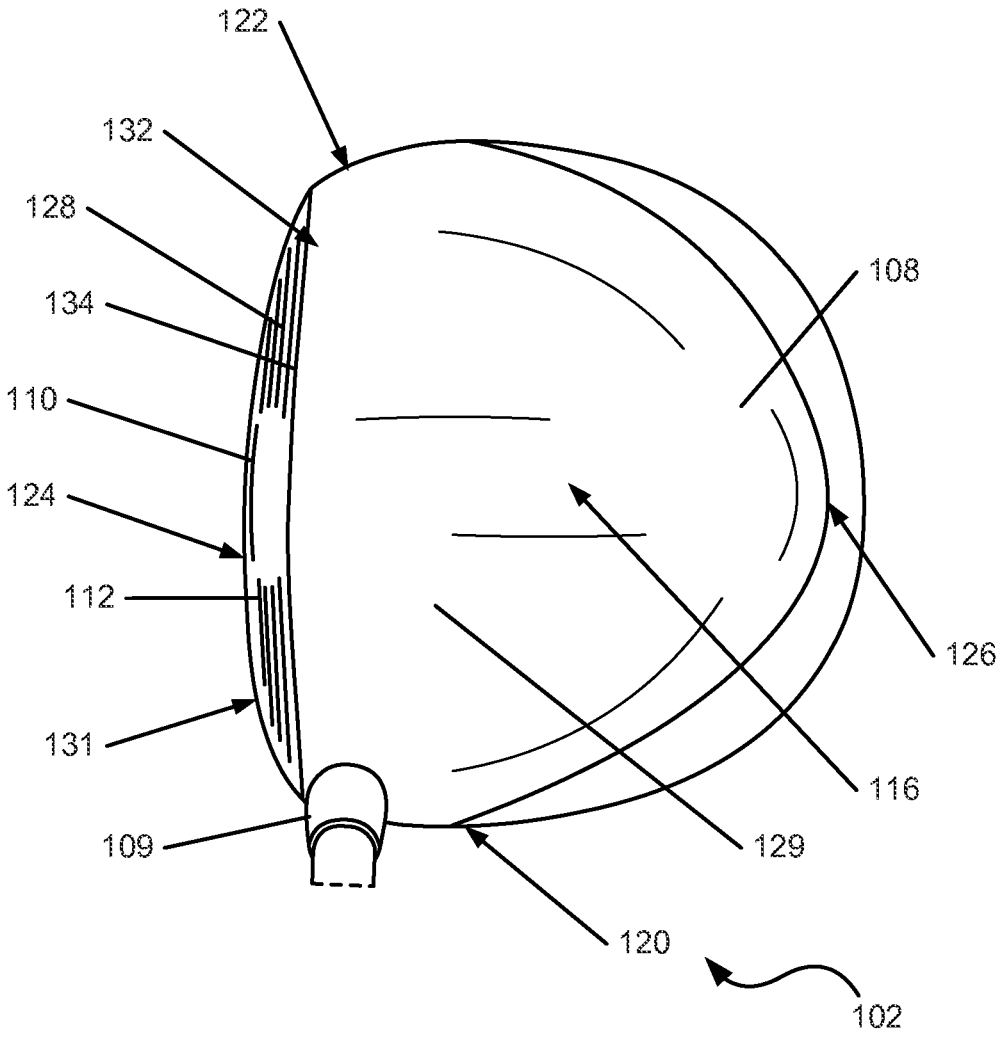
FIG. 4 is a top view of the head of FIG. 2.

It is understood that the relative sizes and thicknesses of the components shown in the figures, including FIGS. 5-7B, may be distorted in order to show relevant detail.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, and welding (including brazing, soldering, or the like), where separation of the joined pieces cannot be accomplished without structural damage thereto.

In general, aspects of this invention relate to ball striking devices, such as golf club heads, golf clubs, and the like. Such ball striking devices, according to at least some examples of the invention, may include a ball striking head and a ball striking surface. In the case of a golf club, the ball striking surface is a substantially flat surface on one face of the ball striking head. It is understood that some golf clubs or other ball striking devices may have more than one ball striking surface. Some more specific aspects of this invention relate to wood-type golf clubs and golf club heads. Alternately, some aspects of this invention may be practiced with iron-type golf clubs and golf club heads, hybrid clubs, chippers, putters, etc.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other composites. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to the invention relate to golf club head structures, including heads for wood-type golf clubs, such as drivers, fairway woods, etc. Other examples of ball striking devices according to the invention may relate to iron-type golf clubs, such as long iron clubs (e.g., driving irons, zero irons through five irons), short iron clubs (e.g., six irons through pitching wedges, as well as sand wedges, lob wedges, gap wedges, and/or other wedges), as well as hybrid clubs, putters, chippers, and other types of clubs. Such devices may include a one-piece construction or a multiple-piece construction. Example structures of ball striking devices according to this invention will be described in detail below in conjunction with FIG. 1, which illustrates an example of a ball striking device 100 in the form of a golf driver, and FIG. 14, which illustrates an example of a ball striking device 300 in the form of an iron-type club, in accordance with at least some examples of this invention.

FIGS. 1-8 illustrate a ball striking device 100 in the form of a golf driver, in accordance with at least some examples of the invention, and FIGS. 9-13 illustrate various additional embodiments of a golf driver in accordance with aspects of the invention. As shown in FIG. 1, the ball striking device 100 includes a ball striking head 102 and a shaft 104 connected to the ball striking head 102 and extending therefrom. The ball striking head 102 of the ball striking device 100 of FIG. 1 has a face 112 connected to a body 108, with a hosel 109 extending therefrom. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIG. 1, the head 102 has a relatively large volume, as the club 100 is designed for use as a driver, intended to hit the ball 106 (shown in FIGS. 5-7) accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. If instead configured as a fairway wood, the head may have a volume of 120 cc to 230 cc, and if configured as a hybrid club, the head may have a volume of 85 cc to 140 cc. Other appropriate sizes for other club heads may be readily determined by those skilled in the art.

In the illustrative embodiment illustrated in FIGS. 1-8, the head 102 has a hollow structure defining an inner cavity 103 (e.g., defined by the face 112 and the body 108). Thus, the head 102 has a plurality of interior surfaces defining the cavity 103, including the inner surface 111 of the face 112, as well as inner surfaces 107 of the body 108. In one embodiment, the hollow inner cavity 103 may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity 103 may not be completely enclosed in some embodiments. In the embodiment illustrated in FIGS. 1-8, the body 108 of the head 102 has a rounded rear profile. In other embodiments, the body 108 of the head 102 can have another shape or profile, including a squared or rectangular rear profile, or other any of a variety of other shapes. FIG.

Figure 12:
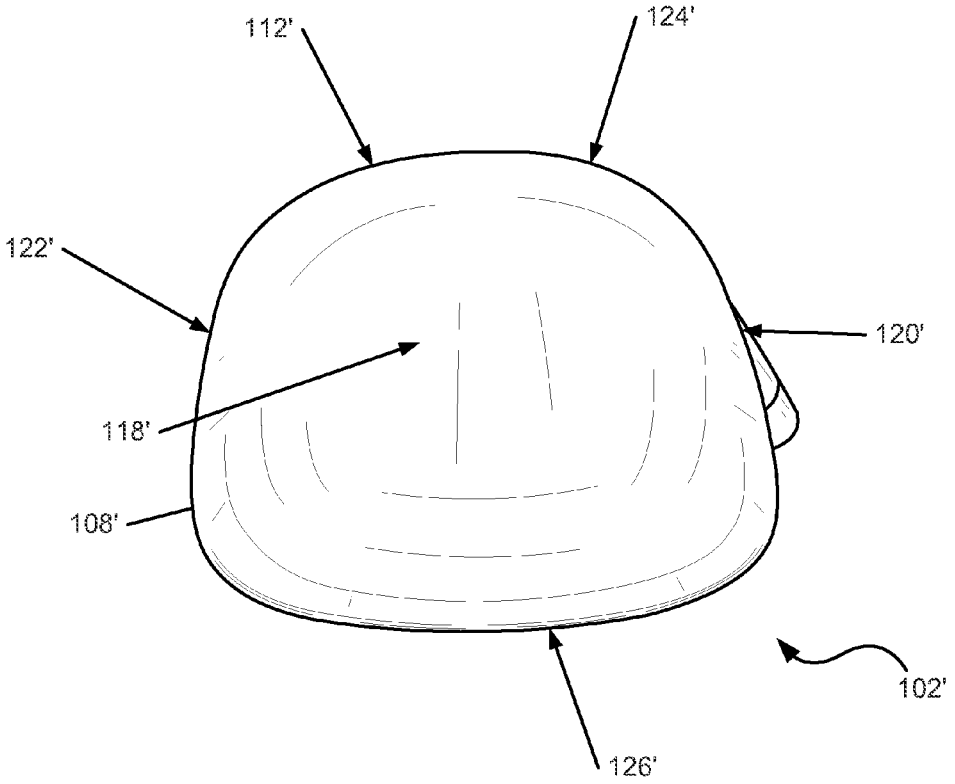
FIG. 12 is a bottom view of another illustrative embodiment of a wood-type golf club head according to aspects of the present invention.

12 illustrates a head 102' with a body 108' having a squared or rectangular rear profile, and it is understood that any of the features of the head 102 of FIGS. 1-8 or any other embodiment described herein can be incorporated into a head 102' as shown in FIG. 12. For reference, FIG. 12 also illustrates the front 124', rear 126', heel 120', toe 122', sole 118', and face 112' of the head 102'. It is understood that such shapes may be configured to distribute weight away from the face 112 and/or the geometric/volumetric center of the head 102, in order to create a lower center of gravity and/or a higher moment of inertia. The body 108 may be connected to a hosel 109 for connection to a shaft 104, as described below.

The face 112 is located at the front 124 of the head 102, and has a ball striking surface 110 located thereon and an inner surface 111 opposite the ball striking surface 110. The ball striking surface 110 is typically an outer surface of the face 112 configured to face a ball 106 in use, and is adapted to strike the ball when the device 100 is set in motion, such as by swinging. The face 112 is defined by a plurality of peripheral edges, including a top edge 113, a bottom edge 115, a heel edge 117, and a toe edge 119. Additionally, in this embodiment, the face 112 has a plurality of face grooves 121 on the ball striking surface 110, which do not extend across the center of the face 112. In another embodiment, such as a fairway wood head a hybrid wood-type head, the face 112 may have grooves 121 that extend across at least a portion of the center of the face 112.

As shown, the ball striking surface 110 is relatively flat, occupying most of the face 112. For reference purposes, the portion of the face 112 nearest the top face edge 113 and the heel 120 of the head 102 is referred to as the "high-heel area" the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIG. 1, the ball striking surface 110 is inclined slightly (i.e., at a loft angle), to give the ball 106 slight lift and spin when struck. In other illustrative embodiments, the ball striking surface 110 may have a different incline or loft angle, to affect the trajectory of the ball 106. Additionally, the face 112 may have a variable thickness and/or may have one or more internal or external inserts in some embodiments.

It is understood that the face 112, the body 108, and/or the hosel 109 can be formed as a single piece or as separate pieces that are joined together. For example, in the embodiment illustrated in FIGS. 2-8, face 112 is formed as part of a face member 128 in the form of a face plate with the body 108 being partially or wholly formed by a body member 129 connected to the face member 128. The embodiment shown in FIGS. 2-8 illustrates one example of such a structure, described in greater detail below. Other configurations can also be used in other embodiments, including configurations where the face frame member 128 is formed as a "cup face" structure, where the face member has one or more walls extending rearward from the face 112. Additionally, the body member 129 may be made of a single piece or multiple pieces in different embodiments. These pieces may be connected by an integral joining technique, such as welding, cementing, or adhesively joining. Other known techniques for joining these parts can be used as well, including many mechanical joining techniques, including releasable mechanical engagement techniques. If desired, the hosel 109 may be integrally formed as part of the body member 129, although the hosel 109 may be formed as part of the face member 128 in another embodiment, such as where the face member 128 is a cup face member. Further, a gasket (not shown) may be included between the face member 128 and the body member 129 in some embodiments.

In the embodiment illustrated in FIGS. 2-8, the body member 129 has mounting structure for connection to the face member 128, which may include a mounting portion 130 in the form of a block or other member. As illustrated in FIGS. 5-8, the body member 128 has an opening 131 defined at the front end 132 thereof, and the mounting portion 130 is positioned around the entire opening 131. In another embodiment, the mounting portion 130 or other mounting structure may be positioned around only a portion of the opening 131. The face member 128 is at least partially received within the opening 131 to connect the face member 128 to the body member 129. As described above, the face member 128 in the embodiment of FIGS. 5-8 is a face plate defined by peripheral edges 134. Additionally, the mounting portion 130 in FIGS. 5-8 includes a platform 133 around at least a portion of the opening 131, and one or more of the peripheral edges 134 of the face member 128 contact the platform 133 to connect the face member 128 to the mounting portion 130. In this embodiment, the platform 133 is a recessed platform that is recessed from the front end 132 of the body member 129, allowing the face member 128 to sit upon the recessed platform 133 while the ball striking surface 110 is substantially flush with the adjacent areas of the body member 129. The face member 128 may be connected to the mounting portion 130 at or around the peripheral edges 134, such as by welding, brazing, soldering, or other integral joining technique, or by using fasteners or another joining technique. In other embodiments, the face member 128 and/or the body member 129 may have a different form, such as a cup face member and a complementary body member as mentioned above, in one example. In another example, the body member 129 may have the mounting portion 130 or other mounting structure located around only a portion of the opening 131, such as by having a plurality of separate blocks or brackets for holding the face member 128 in place. Still other embodiments are contemplated.

The ball striking device 100 may include a shaft 104 connected to or otherwise engaged with the ball striking head 102, as shown in FIG. 1. The shaft 104 is adapted to be gripped by a user to swing the ball striking device 100 to strike the ball 106. The shaft 104 can be formed as a separate piece connected to the head 102, such as by connecting to the hosel 109, as shown in FIG. 1. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/

0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention.

The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp golf club shaft 104, as shown in FIG. 1. The grip element 105 may be attached to the shaft 104 in any desired manner, including in conventional manners known and used in the art (e.g., via adhesives or cements, threads or other mechanical connectors, swedging/swaging, etc.).

In general, ball striking heads as described herein contain a deformation limiting member 140 that is located behind the face 112 and limits deformation of the face 112 under certain conditions. In one example embodiment, the face 112 and the deformation limiting member 140 are adapted such that an impact of the ball 106 on the ball striking surface 110 causes deformation of the face 112 toward the deformation limiting member 140, and when the deformation of the face 112 is sufficient to cause the inner surface 111 of the face 112 to engage the deformation limiting member 140, the deformation limiting member 140 exerts a force on the face 112 to resist further deformation of the face 112. The degree of deformation of the face 112 can be dependent on several factors, including the swing speed of the head 102. Accordingly, in one embodiment, impacts of the ball 106 on the face 112 below a threshold impact velocity (i.e. swing speed) do not deform the face 112 sufficiently to engage the deformation limiting member 140, and impacts of the ball 106 on the face 112 above the threshold impact velocity can deform the face 112 sufficiently to engage the deformation limiting member 140. The degree of deformation of the face 112 can also depend on other factors, such as the stiffness of the face 112, the mass and flexibility of the ball 106, the location of impact on the face 112, etc. Thus, it is understood that the head 102 may be customized or tuned to different threshold swing speeds, and that external factors (e.g., properties of the ball 106) may cause the face 112 to deform differently.

Figure 5:
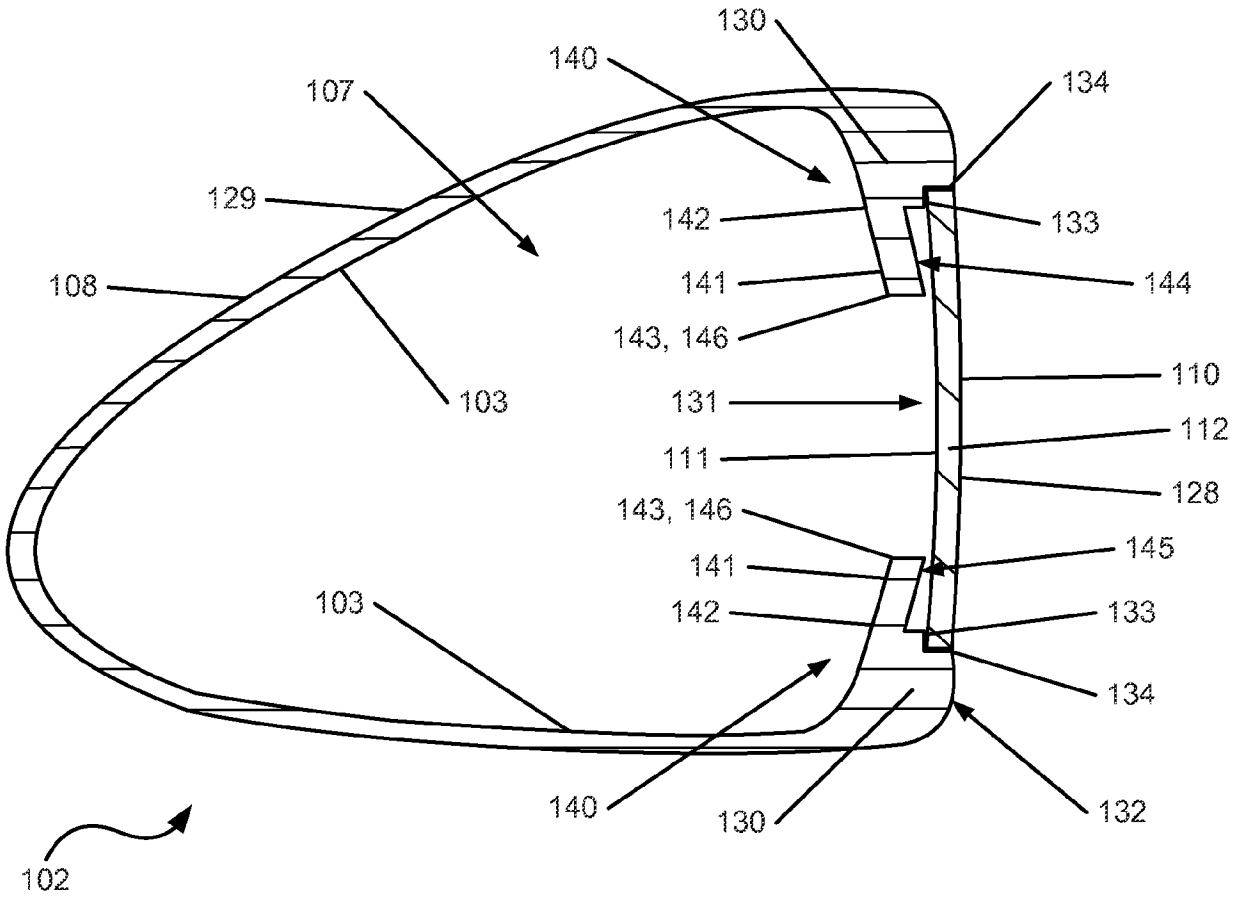
FIG. 5 is a cross-section view of the head of FIG. 2, taken along lines 5-5 of FIG. 2.
Figure 6:
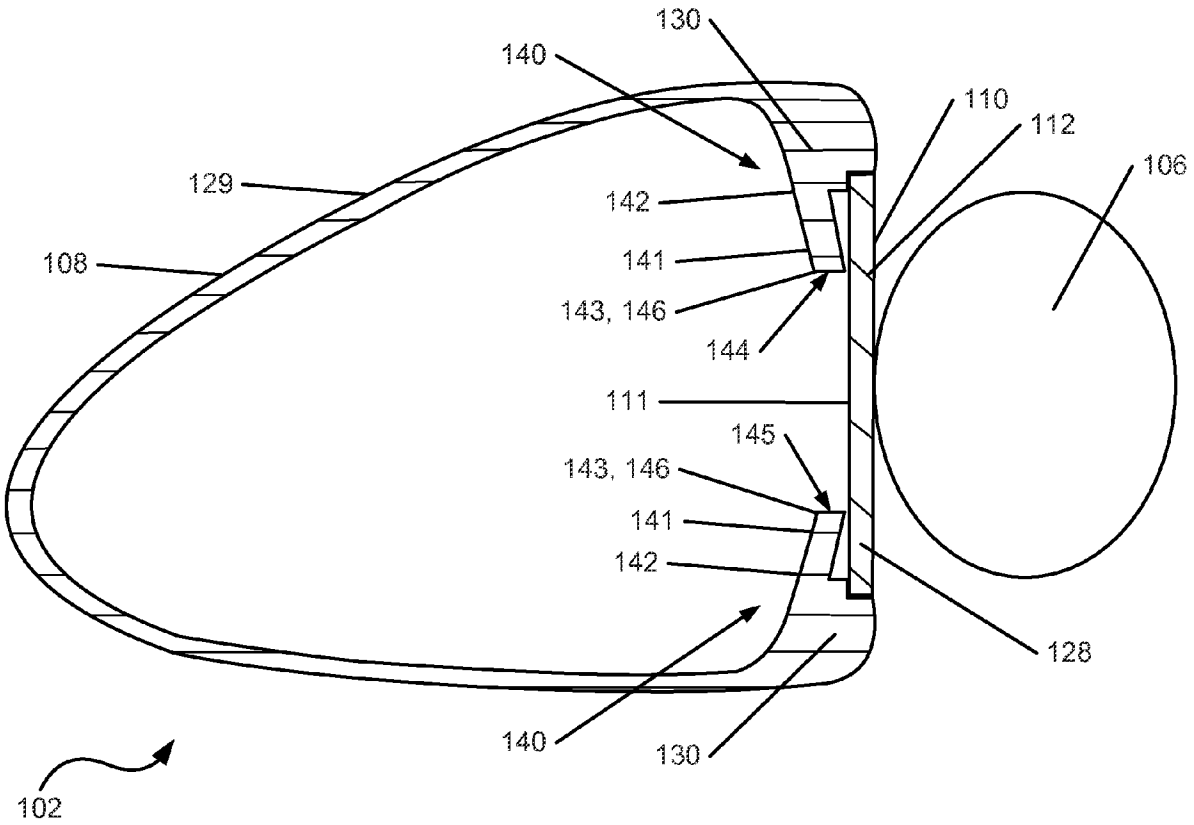
FIG. 6 is a cross-section view of the head as shown in FIG. 5, illustrated during a low-speed impact with a ball.
Figure 7:
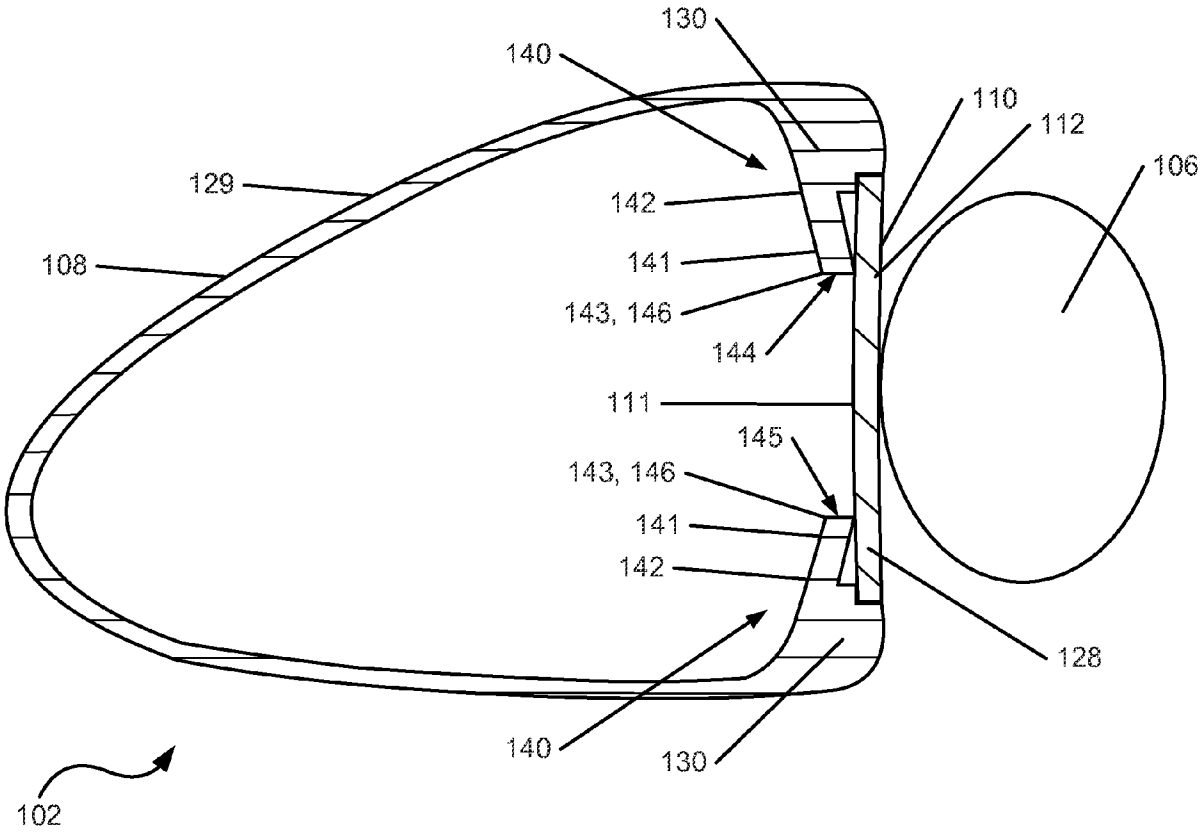
FIG. 7 is a cross-section view of the head as shown in FIG. 5, illustrated during a high-speed impact with a ball.
Figure 8:
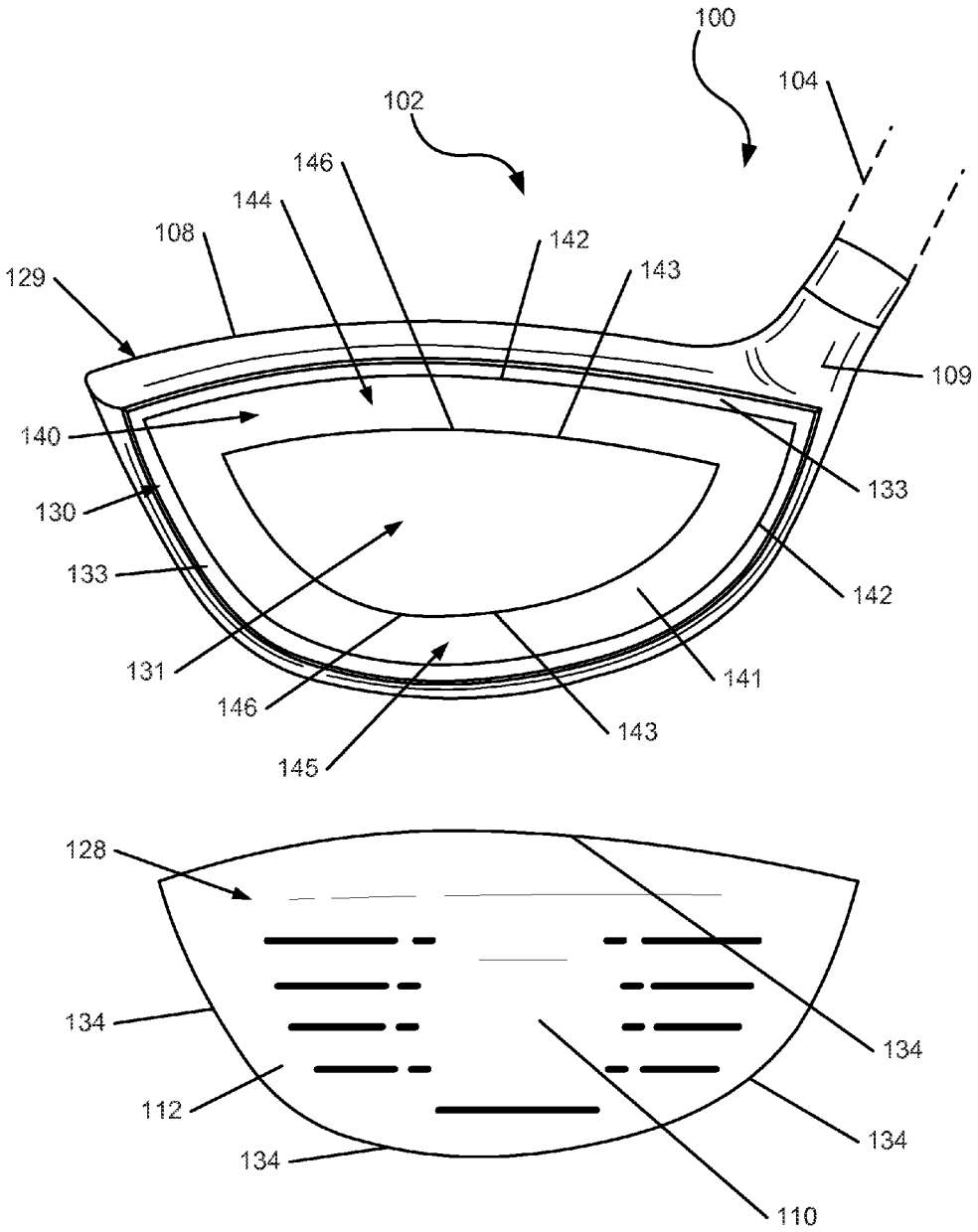
FIG. 8 is a partially-exploded front view of the head of FIG. 2, showing a face member separated from a body member of the head.

In one embodiment, such as the head 102 illustrated in FIGS. 2-8, the deformation limiting member 140 extends from one of the interior surfaces of the head 102, e.g. the inner surface 107 of the body 108, to a point that is spaced a distance from the inner surface 111 of the face 112. In this embodiment, the deformation limiting member 140 is formed by a flange 141 that extends from an inner surface 107 of the body 108 around at least a portion of the periphery of the face 112 and around at least a portion of the opening 131. In the head 102 of FIGS. 2-8, the flange 141 has a fixed end 142 that is fixed to the inner surface 107 of the body 108 at the mounting portion 130 and a free end 143 that is positioned proximate the inner surface 111 of the face 112. The fixed end 142 may be positioned on one or more inner surfaces 107 of the body 108 and/or adjacent one or more of the peripheral edges 113, 115, 117, 119 of the face 112. As shown in FIG. 5, the deformation limiting member 140 extends both inwardly into the cavity 103 and toward the face 112 so that the free end 143 of the deformation limiting member 140 is spaced a small distance from the inner surface 111 of the face 112. In one embodiment, such as the embodiment in FIGS. 2-8, the deformation limiting member 140 has a first portion or top portion 144 extending from the top side of the body 108 toward the inner surface 111 of the face 112 and a second portion or bottom portion 145 extending from the bottom side of the body 108 toward the inner surface 111 of the face 112. In the embodiment of FIGS. 2-8, the first and second portions 144, 145 of the deformation limiting member 140 extend from the mounting portion 130 generally toward the center of the face 112, but terminate short of reaching the center or contacting the face 112. As shown in FIG. 8, the flange 141 extends around the entire periphery of the face 112 and the entire opening 131, forming a ring-like structure, such that the free end 143 of the deformation limiting member 140 terminates in an inner edge 146 shaped similarly to the opening 131. Viewed another way, the first portion 144 extends inwardly from a point proximate the top peripheral edge 113 of the face 112, and the second portion 145 extends inwardly from a point proximate the bottom peripheral edge 115 of the face 112.

The deformation limiting member 140 may have a different configuration in other embodiments, including the configurations shown in FIGS. 9-11, 13, and 16 described below. For example, the flange 141 may extend parallel to the face 112 in one embodiment, and the flange 141 may have a fixed end 142 that is farther spaced from the face 112 in another embodiment. In a further embodiment, the flange 141 may form a wall or brace extending completely across the cavity 103, and may not have a defined inner edge 146. It is understood that the deformation limiting member 140 may include any combination of these features or other features described herein.

FIGS. 6-7 illustrate the behavior and function of the face 112 and the deformation limiting member 140 upon impact with a ball 106 at different swing speeds. FIG. 6 illustrates an impact of the ball 106 approximately on the center of the face 112 at a low swing speed. As shown in FIG. 6, the face 112 deforms by flexing inwardly upon impact with the ball 106, but the energy of the impact does not sufficiently deform the face 112 to a point where the deformation limiting member 140 contacts the inner surface 111 of the face 112. Thus, in the impact shown in FIG. 6, the deformation limiting member 140 does not influence the physics of the impact on the face 112 or the behavior of the face 112 during impact. FIG. 7 illustrates an impact of the ball 106 approximately on the center of the face 112 at a higher swing speed. As shown in FIG. 7, the face 112 deforms by flexing inwardly upon impact with the ball 106, and the energy of the impact sufficiently deforms the face 112 to a point where the deformation limiting member 140 engages the inner surface 111 of the face 112 and exerts a force on the inner surface 111 of the face 112. The force exerted by the deformation limiting member 140 on the face 112 resists and/or limits further deformation of the face 112 inwardly. Additionally, the contact between the deformation limiting member 140 and the face 112 creates a contact point or "brace" inwardly from the outer edges 113, 115, 117, 119 of the face 112. This can change the deformation profile of the face 112, i.e., further deformation of the face 112 generally occurs in a smaller area located inward of the contact point(s) between the face 112 and the deformation limiting member 140, which can also increase the bending stiffness of the face 112 (or at least of the portion of the face 112 being deformed). Thus, in the impact shown in FIG. 7, the force exerted by the deformation limiting member 140 on the face 112 influences the physics of the impact on the face 112 and the behavior of the face 112 during impact. In one embodiment, the deformation limiting member 140 may be a high-stiffness member that effectively stops further deformation of the face 112 upon contact with the face 112. In another embodiment, the deformation limiting member 140 may be a resiliently flexible member or spring-like member that can flex when contacted by the face 112 to allow some further deformation of the face 112. By limiting the deformation of the face 112, the deformation limiting member 140 can control the contact time and/or COR of the face 112 at higher swing speeds.

In one embodiment, the head 102 may have a threshold swing speed, where impacts above the threshold swing speed deform the face 112 sufficiently that the deformation limiting member 140 engages the face as described above, and impacts below the threshold swing speed do not sufficiently deform the face 112 to contact the deformation limiting member 140. For example, the threshold swing speed in one embodiment may be approximately 105 mph, for an impact in the center and/or area of highest response of the face 112. In another embodiment, the threshold swing speed may be approximately 100 mph, and in a further embodiment, the threshold swing speed may be approximately 95 mph. Such threshold swing speeds may depend at least partially on the mass of the object being struck, and it is understood that the threshold swing speed may be different for striking different objects having different masses. In one embodiment, the threshold swing speeds discussed above may be applicable for striking a regulation golf ball 106 having a maximum weight of approximately 1.62 oz. Additional characteristics of the struck object, the face 112, and/or the impact itself may influence the threshold speed. For example, the location of the impact on the face 112, the angle of the face 112 at impact, the flexibility of the object being struck, and any inherent non-linear impact properties of the face 112 and/or the object may affect the threshold swing speed. In one embodiment, the threshold swing speed identified above may be adapted for substantially square impacts with a regulation golf ball 106, at or around the center of the face 112 and/or the area of highest response of the face 112. It is understood that changes in the properties of the face 112, such as the local or overall stiffness of the face 112, which may be dependent on both the modulus and the cross-sectional moment of inertia of the face 112, may raise or lower the threshold swing speed. Additionally, the distance from the inner surface 111 of the face 112 to the deformation limiting member 140 may also affect the threshold velocity, as a deformation limiting member 140 that has a free end 143 spaced farther from the face 112 may require greater impact energy to sufficiently deform the face 112, and vice versa.

Figure 9:
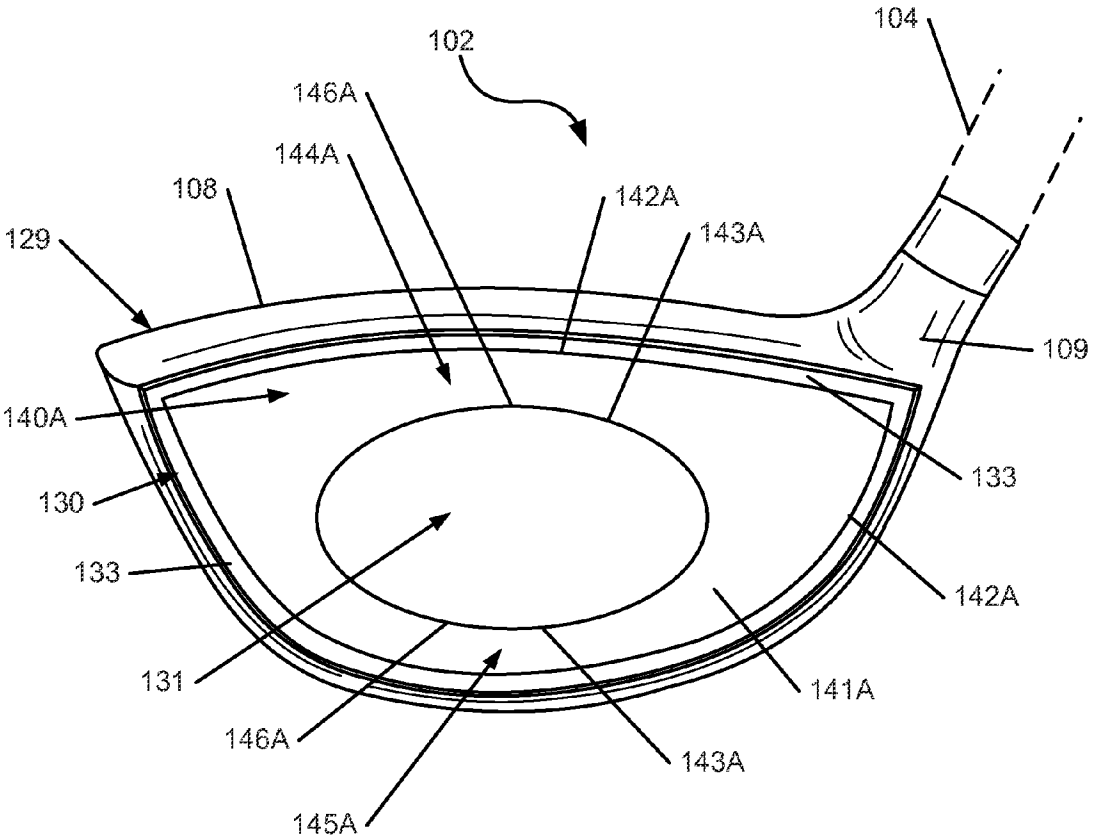
FIG. 9 is a front view of a body member of another illustrative embodiment of a wood-type golf club head according to aspects of the present invention, which may be utilized with a face as shown in FIG. 8.
Figure 10:
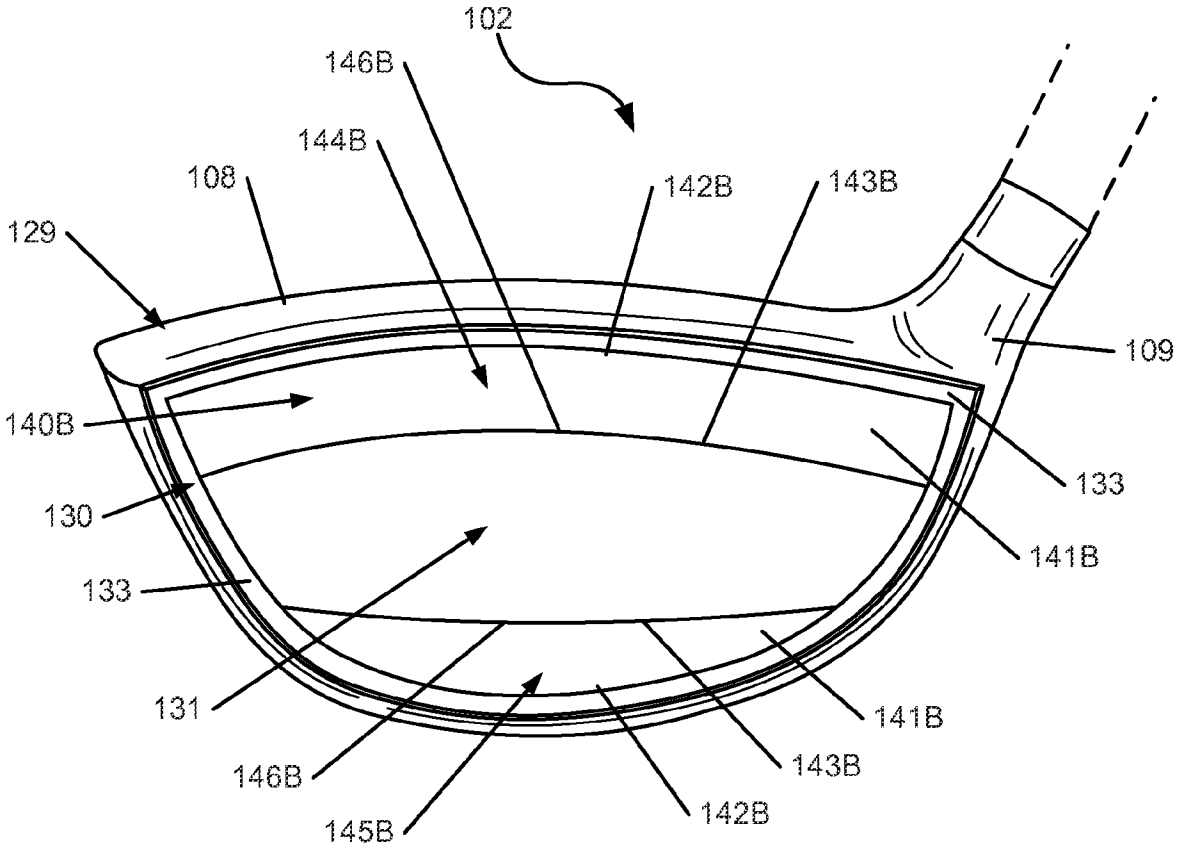
FIG. 10 is a front view of a body member of another illustrative embodiment of a wood-type golf club head according to aspects of the present invention, which may be utilized with a face as shown in FIG. 8.
Figure 11:
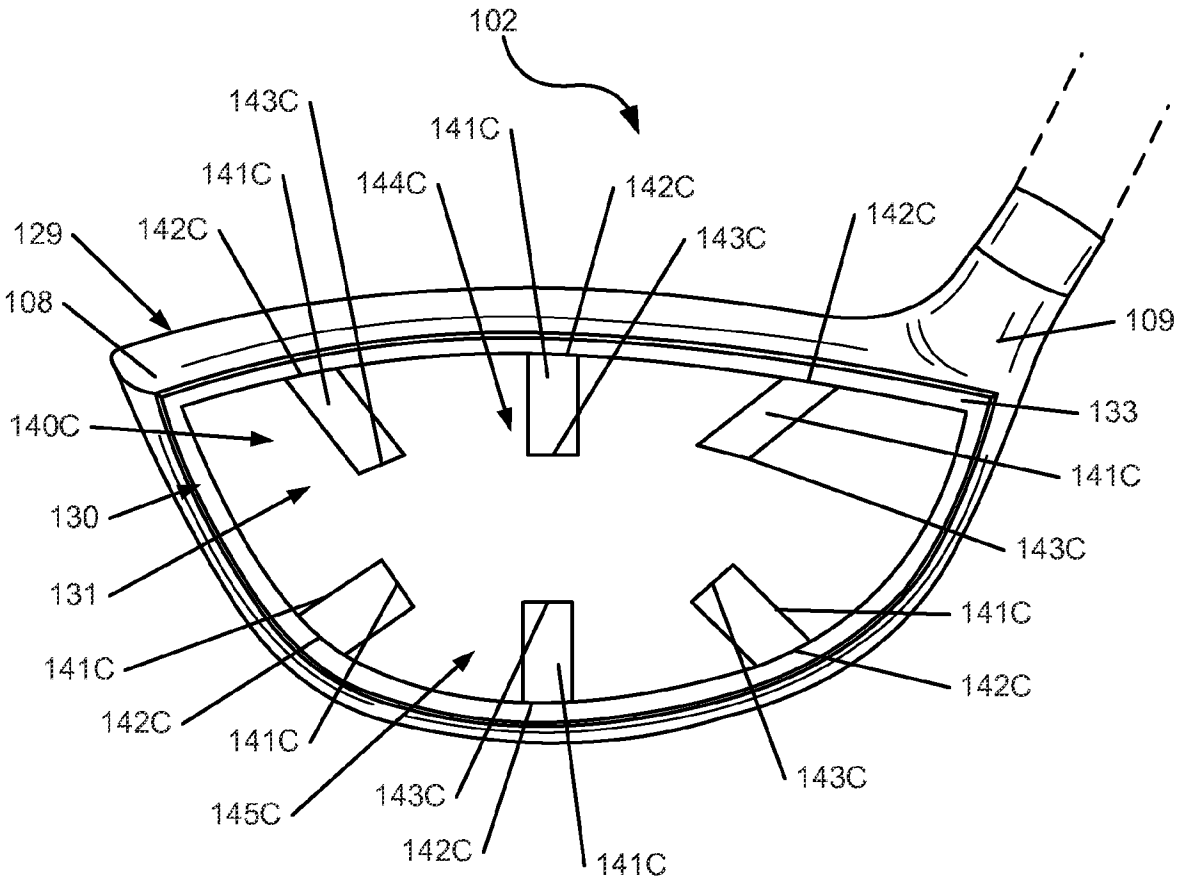
FIG. 11 is a front view of a body member of another illustrative embodiment of a wood-type golf club head according to aspects of the present invention, which may be utilized with a face as shown in FIG. 8.

FIGS. 9-11 illustrate other embodiments of the head 102 of FIGS. 2-8 which utilize different deformation limiting members 140A-C. The head 102 of FIG. 9 includes a deformation limiting member 140A that has first and second portions 144A, 145A with a fixed end 142A connected to the mounting portion 130 and extending generally toward the center of the face 112, but terminating short of reaching the center or contacting the face 112. As shown in FIG. 9, the flange 141A extends around the entire periphery of the face 112 and the entire opening 131, forming a ring-like structure, such that the free end 143A of the deformation limiting member 140 terminates in a circular or elliptical inner edge 146A spaced a distance from the face 112. The head 102 of FIG. 10 includes a deformation limiting member 140B that has a first (top) portion 144B extending from the top side of the body 108 and a separate second (bottom) portion 145B extending from the bottom side of the body 108. In this embodiment, the top and bottom portions 144B, 145B are formed by flanges 141B, each having a fixed end 142B connected to the mounting portion 130, and a free end 143B forming an inner edge 146B that extends proximate the face 112 and is spaced a distance from the face 112, similar to the deformation limiting member 140 in FIG. 5. The head 102 of FIG. 11 includes a deformation limiting member 140C that has a plurality of braces 141C each having a fixed end 142C connected to the mounting portion 130 and a free end 143C that extends proximate the face 112 and is spaced a distance from the face 112. The braces 141C extending from the top side of the body 108 may collectively be considered a top portion 144C the braces 141C extending from the bottom side of the body 108 may collectively be considered a bottom portion 145C. The deformation limiting members 140A-C of FIGS. 9-11 function similarly to the deformation limiting member 140 of FIGS. 2-8, as described above.

Figure 13:
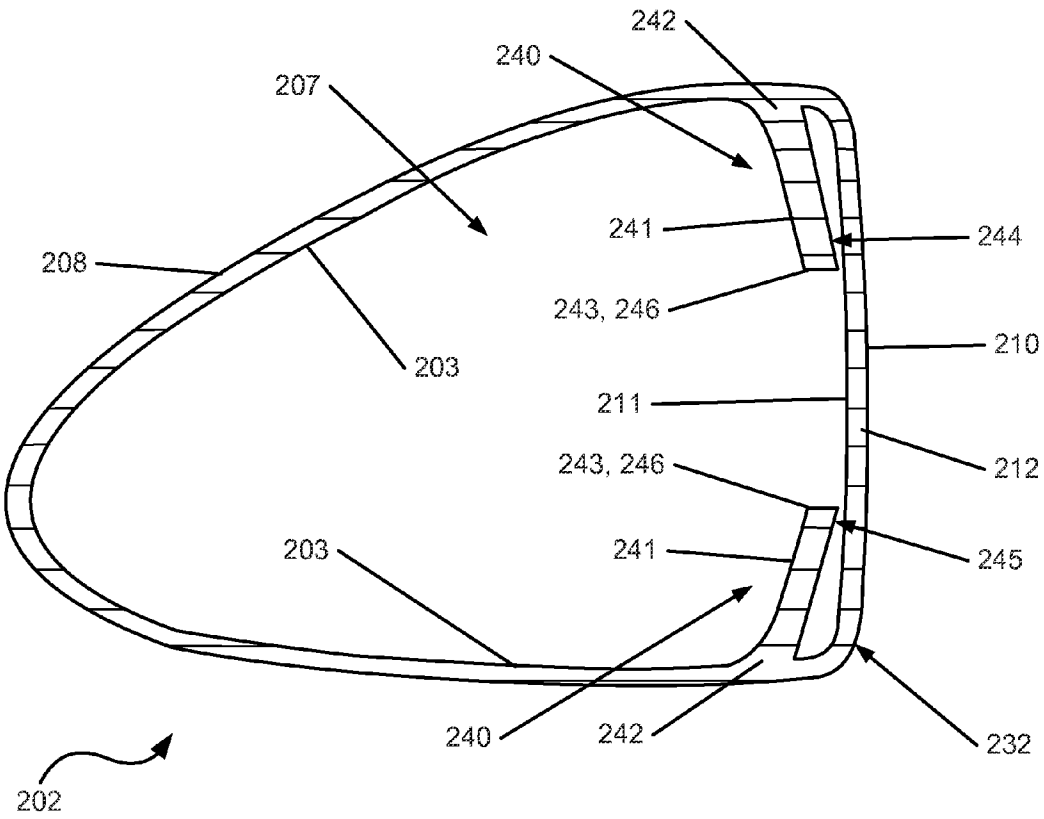
FIG. 13 is a cross-section view of another embodiment of an iron-type golf club head according to aspects of the present invention.

FIG. 13 illustrates a ball striking device 200 in the form of a wood-type golf club head 202, in accordance with at least some examples of this invention. Many common components between the ball striking device 100 of FIGS. 1-8 and the ball striking device 200 of FIG. 13 are referred to using similar reference numerals in the description that follows, using the "2xx" series of reference numerals. Accordingly, certain features of the head 202 of FIG. 13 that are already described above may described below using less detail, or may not be described at all. In this embodiment, the face 212 and the body 208 of the head 202 are connected by a mounting configuration and connecting structure that is different from the head 102 of FIGS. 1-8. For example, the head 202 has no mounting block. The head 202 of FIG. 13 may have a cup face structure connected to a body member, or a face 112 that is integrally formed with the body 108, among other possible connecting structures. In this embodiment, the head 202 includes a deformation limiting member 240 that has first and second portions 244, 245 with fixed ends 242 connected to the inner surface 207 of the body 208 and extending generally toward the center of the face 212, but terminating short of reaching the center or contacting the face 212, similarly to the deformation limiting member 140 of FIGS. 1-8. The deformation limiting member 240 of FIG. 13 may not be connected to an identifiable mounting portion, in contrast to the embodiment illustrated in FIGS. 1-8. Additionally, the deformation limiting member 240 of FIG. 13 is configured similarly to the flange 141 of FIGS. 1-8, and includes a flange 241 extending around the entire periphery of the face 212, terminating in an inner edge 246 proximate the face 212 and spaced a distance from the face 212. The deformation limiting member 240 of FIG. 13 functions similarly to the deformation limiting member 140 of FIGS. 2-8, as described above. In other embodiments, the deformation limiting member 240 may have another configuration, including any of the configurations shown in FIGS. 9-11, and the head 202 may include any other features described herein. In one embodiment, where the face 212 is formed as part of a cup-face structure, the fixed end 242 of the deformation limiting member 240 may be connected to one of the walls of the cup-face structure extending rearwardly from the face 212, and different cup-face members having different deformation limiting members 240 may be configured for connection with a body member.

Figure 14:
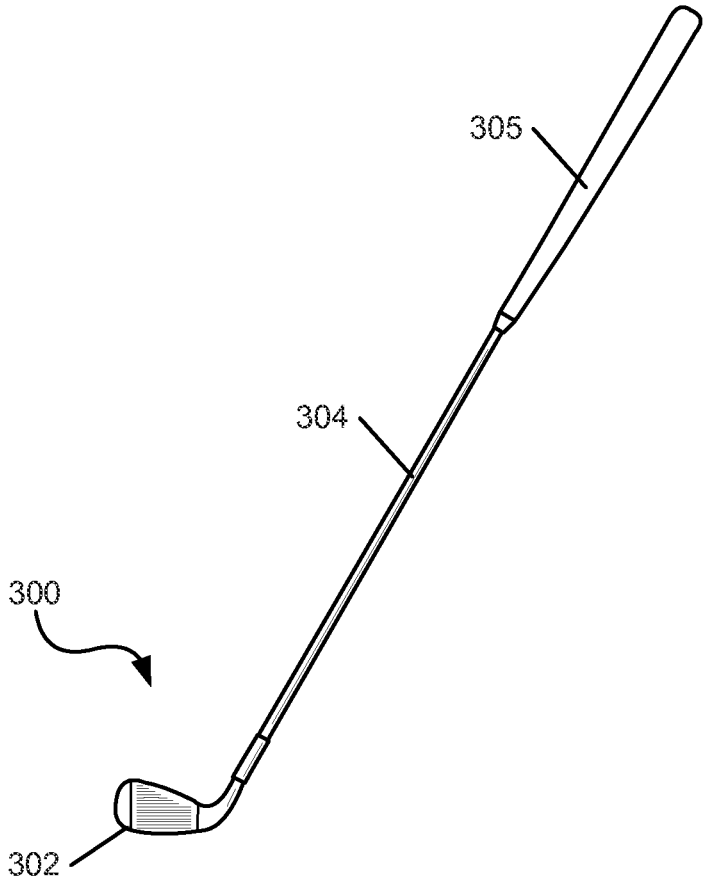
FIG. 14 is a front view of an illustrative embodiment of an iron-type ball striking device according to aspects of the present invention.
Figure 15:
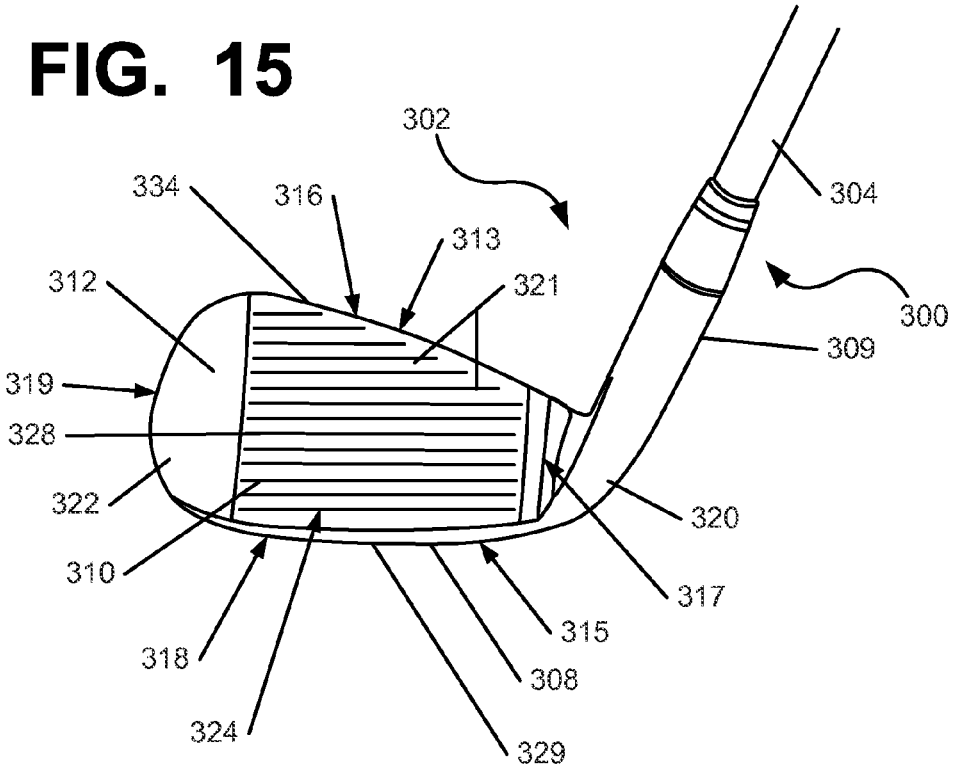
FIG. 15 is a front view of a head of the ball striking device of FIG. 14.
Figure 16:
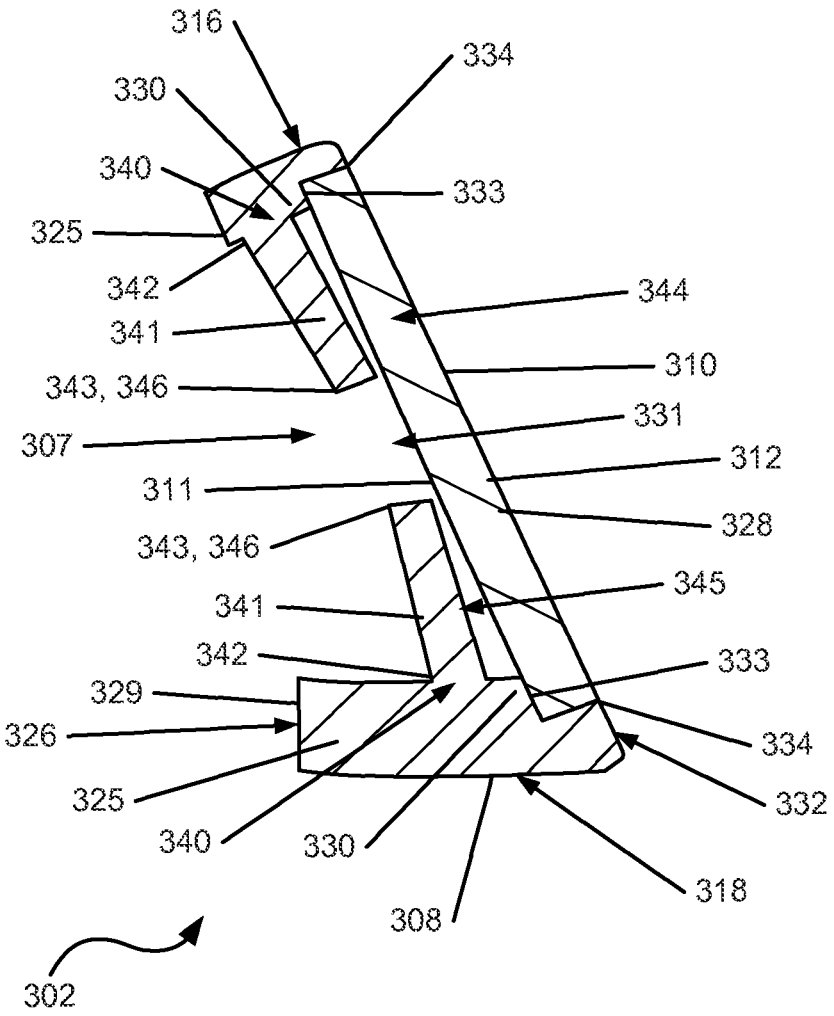
FIG. 16 is a cross-section view of the head of FIG. 15, taken along lines 16-16 of FIG. 15.

FIGS. 14-16 illustrate a ball striking device 300 in the form of a golf iron, in accordance with at least some examples of this invention. Many common components between the ball striking device 100 of FIGS. 1-8 and the ball striking device 300 of FIGS. 14-16 are referred to using similar reference numerals in the description that follows, using the "3xx" series of reference numerals. The ball striking device 300 includes a shaft 304 and a golf club head 302 attached to the shaft 304. The golf club head 302 of FIG. 15-16 may be representative of any iron or hybrid type golf club head in accordance with examples of the present invention.

As shown in FIGS. 14-16, the golf club head 302 includes a face 312, a body 308 extending rearward from the face 312, and a hosel 309 extending from the head 302 for attachment of the shaft 304. For reference, the head 302 generally has a top 316, a bottom or sole 318, a heel 320 proximate the hosel 309, a toe 322 distal from the hosel 309, a front 324, and a back or rear (not shown). The shape and design of the head 302 may be partially dictated by the intended use of the device 300. The heel portion 320 is attached to and/or extends from a hosel 309 (e.g., as a unitary or integral one piece construction, as separate connected elements, etc.). The head 302 shown in FIGS. 14-16 has an open rear cavity 303 that is defined by a plurality of inner surfaces 307, and the body 308 includes walls 325 extending rearwardly from the face 312 to at least partially define the cavity 303. Other embodiments of iron-type heads may also be used in connection with the invention, including heads with differently sized or configured cavities, heads with partially or completely closed rear cavities, and blade-type heads that include no rear cavity.

The face 312 is located at the front 324 of the head 302, and has an outer surface 310, as well as a rear surface 311 located opposite the outer surface 310, which may be considered an inner surface of the face 312. The face 312 is defined by a plurality of peripheral edges, including a top edge 313, a bottom edge 315, a heel edge 317, and a toe edge 319. The face 312 also has a plurality of face grooves 321 on the ball striking surface 310. For reference purposes, the portion of the face 312 nearest the top face edge 313 and the heel 320 of the head 302 is referred to as the "high-heel area"; the portion of the face 312 nearest the top face edge 313 and toe 322 of the head 302 is referred to as the "high-toe area"; the portion of the face 312 nearest the bottom face edge 315 and heel 320 of the head 302 is referred to as the "low-heel area"; and the portion of the face 312 nearest the bottom face edge 315 and toe 322 of the head 302 is referred to as the "low-toe area". Conceptually, these areas may be recognized and referred to as quadrants of substantially equal size (and/or quadrants extending from a geometric center of the face 312), though not necessarily with symmetrical dimensions. The face 312 may include some curvature in the top to bottom and/or heel to toe directions (e.g., bulge and roll characteristics), as is known and is conventional in the art. The ball striking surface 310 is inclined (i.e., at a loft angle), to give the ball an appreciable degree of lift and spin when struck. In various embodiments, the ball striking surface 310 may have a different incline or loft angle, to affect the trajectory of the ball. For example, in one embodiment, an iron-type golf club head 302 as shown in FIGS. 14-16 may have a loft angle of between 19° and 64°.

The body 308 of the golf club head 302 may be constructed from a wide variety of different materials, including materials conventionally known and used in the art, such as steel, titanium, aluminum, tungsten, graphite, polymers, or composites, or combinations thereof. Also, if desired, the club head 302 may be made from any number of pieces (e.g., having a separate face plate, etc.) and/or by any construction technique, including, for example, casting, forging, welding, and/or other methods known and used in the art. The face 312 may be constructed using any of the materials described above, as well as any other suitable materials.

It is understood that the face 312, the body 308, and/or the hosel 309 can be formed as a single piece or as separate pieces that are joined together, similarly to the head 102 described above and shown in FIGS. 2-8. For example, in the embodiment illustrated in FIG. 16, face 312 is formed as part of a face member 328 in the form of a face plate with the body 308 being partially or wholly formed by a body member 329 connected to the face member 128. The embodiment shown in FIG. 16 illustrates one example of such a structure, described in greater detail below. Other configurations can also be used in other embodiments, and any features, structures, and/or joining techniques described above with respect to the face member 128 and body member 129 of FIGS. 2-8 may be used.

In the embodiment illustrated in FIG. 15-16, the body member 329 has mounting structure for connection to the face member 328, which may include a mounting portion 330 formed at least partially by the walls 325 extending rearwardly from the face 312. As illustrated in FIG. 16, the body member 328 has an opening 331 defined at the front end 332 thereof, and the mounting portion 330 is positioned around the entire opening 331. In another embodiment, the mounting portion 330 or other mounting structure may be positioned around only a portion of the opening 331. The face member 328 is at least partially received within the opening 331 to connect the face member 328 to the body member 329. As described above, the face member 328 in the embodiment of FIGS. 15-16 is a face plate defined by peripheral edges 334. Additionally, the mounting portion 330 in FIGS. 15-16 includes a platform 333 around at least a portion of the opening 331, and one or more of the peripheral edges 334 of the face member 328 contact the platform 333 to connect the face member 328 to the mounting portion 330. In this embodiment, similarly to the embodiment of FIGS. 2-8, the platform 333 is a recessed platform that is recessed from the front end 332 of the body member 329, allowing the face member 328 to sit upon the recessed platform 333 while the ball striking surface 310 is substantially flush with the adjacent areas of the body member 329. The face member 328 may be connected to the mounting portion 330 at or around the peripheral edges 334, such as by welding, brazing, soldering, or other integral joining technique, or by using fasteners or another joining technique. In other embodiments, the face member 328 and/or the body member 329 may have a different form, such as any other configurations described herein.

The ball striking device 300 may include a shaft 304 connected to or otherwise engaged with the ball striking head 302, as shown in FIG. 15 and described above. The shaft 304 is adapted to be gripped by a user to swing the ball striking device 300 to strike the ball. The shaft 304 can be formed as a separate piece connected to the head 302, such as by connecting to the hosel 309, as shown in FIG. 16. Any desired hosel and/or head/shaft interconnection structure may be used without departing from this invention, including those described above.

In the embodiment illustrated in FIGS. 14-16, the head 302 includes a deformation limiting member 340 that is configured similarly to the deformation limiting member 140 of FIGS. 2-8. The deformation limiting member 340 has first and second portions 344, 345 with fixed ends 342 connected to the inner surfaces 307 of the rear cavity 303 and extending generally toward the center of the face 312, but terminating short of reaching the center or contacting the face 312, similarly to the deformation limiting member 140 of FIGS. 1-8. The deformation limiting member 340 of FIGS. 14-16 is connected to the walls 325 that serve to form at least part of the mounting portion 330, but in other embodiments, the deformation limiting member 340 may not be connected to an identifiable mounting portion. Additionally, the deformation limiting member 340 of FIGS. 14-16 is configured similarly to the flange 141 of FIGS. 1-8, and includes a flange 341 extending around the entire periphery of the face 312, terminating in an inner edge 346 proximate the face 312 and spaced a distance from the face 312. The deformation limiting member 340 of FIGS. 14-16 functions similarly to the deformation limiting member 140 of FIGS. 2-8, as described above. In other embodiments, the deformation limiting member 340 may have another configuration, including any of the configurations shown in FIGS. 9-11 and 13, and the head 302 may include any other features described herein, which may be modified for use in an iron-type head 302.

Several different embodiments have been described above, including the various embodiments of golf clubs 100 and heads 102, 102', 202, 302 (referred to herein as 102, et seq.) and portions thereof described herein. It is understood that any of the features of these various embodiments may be combined and/or interchanged. For example, as described above, various different combinations of club heads 102, et seq. with differently configured deformation limiting members 140, et seq. may be used, including the configurations described herein, variations or combinations of such configurations, or other configurations. In further embodiments, at least some of the features described herein can be used in connection with other configurations of wood-type clubs, iron-type clubs, other golf clubs, or other types of ball-striking devices.

Heads 102, et seq. incorporating the features disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head with a deformation limiting member 140, et seq., as described above.

Figure 7A:
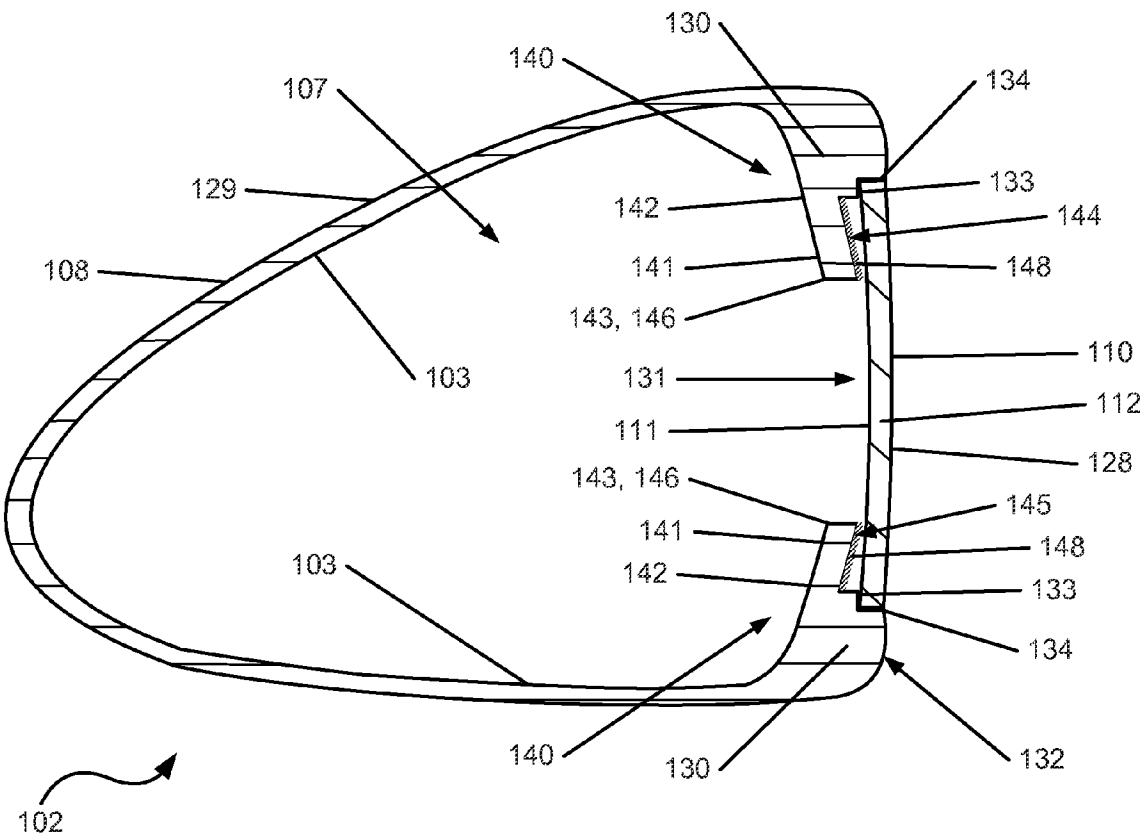
FIG. 7A is a cross-section view of the head as shown in FIG. 5, with an insert connected to a deformation limiting member of the head.
Figure 7B:
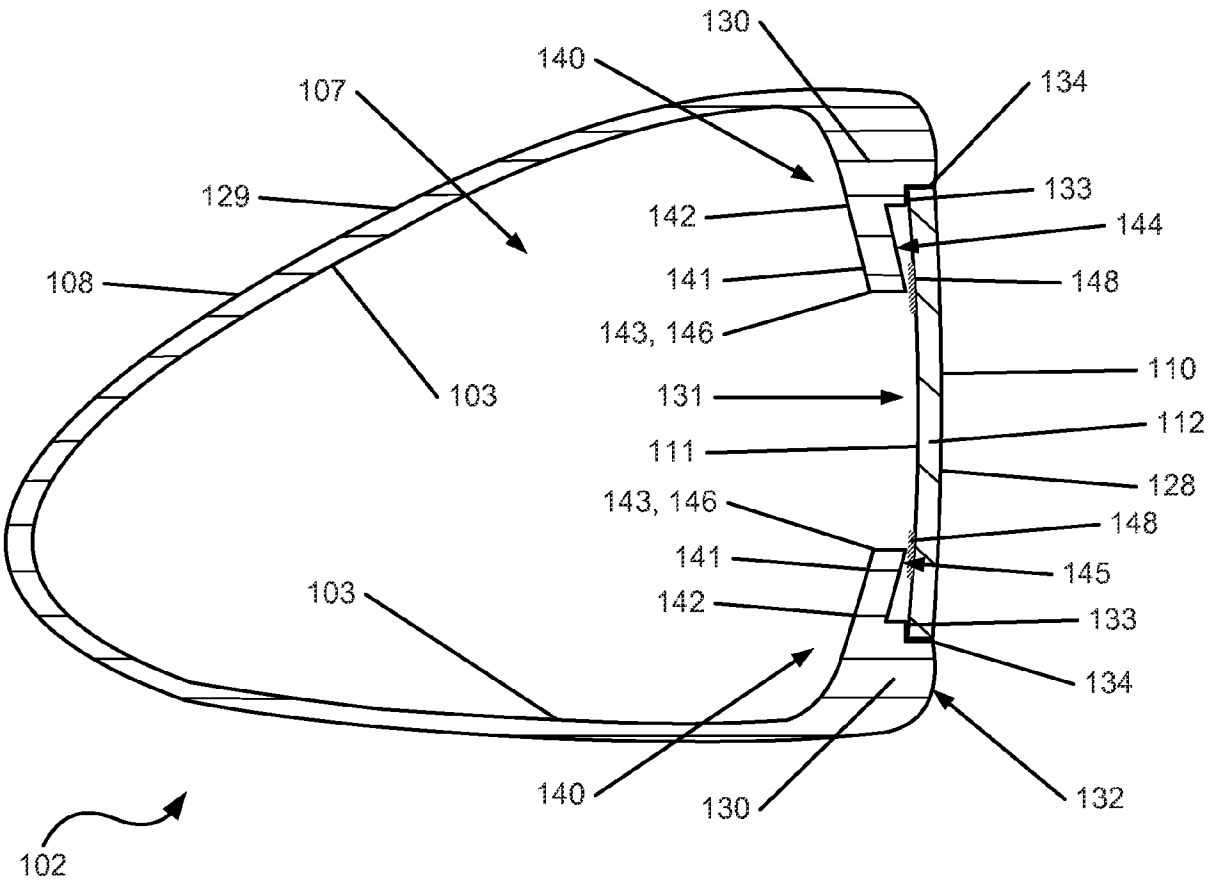
FIG. 7B is a cross-section view of the head as shown in FIG. 5, with an insert connected to an inner surface of a ball striking face of the head.

Additionally, the heads 102, et seq., golf clubs 100, et seq., or other ball striking device may be fitted or customized for a particular user. Such customization is described below with respect to the head 102 of FIGS. 2-8, but it is understood that the same or similar manners of customization may be used with other heads 102', 202, 302 described herein. In one embodiment, the head 102 can be customized by selecting a body member 129 from a plurality of body members with differently configured deformation limiting members 140, and connecting a face member 128 to the selected body member 129. For example, different body members 129 may have deformation limiting members 140 that have different flexibilities, which provide different responses when the face 112 engages the deformation limiting member 140. As another example, different body members 129 may have deformation limiting members 140 that have free ends 143 spaced different distances from the inner surface 111 of the face 112, which may alter the threshold velocity for causing the face 112 to engage the deformation limiting member 140. In another embodiment, structures may be used to alter the spacing distance between the deformation limiting member(s) 140 and the face 112, which can provide different response characteristics without using a different face 112 or deformation limiting member 140. For example, as shown in FIGS. 7A-7B, inserts 148 may be connected to the surface of the deformation limiting member 140 (FIG. 7A) and/or to the inner surface 111 of the face 112 (FIG. 7B), to change this spacing distance. It is understood that such inserts 148 may be used in connection with any embodiment shown and/or described herein. Other structures may be used in other embodiments. In a further embodiment, the head 102 can be customized by selecting a face member 128 from a plurality of differently configured face members, and connecting the face member 128 to a body member 129. Different face members 112 may have different properties, such as different stiffnesses, which can create different response and/or change the threshold velocity when the deformation limiting member 140 engages the face 112. The stiffness and/or response of different faces 112 can be influenced by several properties, such as material properties (e.g., modulus), thickness, curvature, cross-sectional shape, structural features, etc. Further, the face 112 may be removable, such as by using screws or other fasteners to mount the face 112 on the mounting portion 130, which can permit interchanging of the face 112 with another face having a different stiffness or response. It is understood that both the face member 128 and the body member 129 can be selected from a plurality of different face and body members. Still other options for customization are possible.

The ball striking devices and heads therefor as described herein provide many benefits and advantages over existing products. For example, a ball striking head containing a deformation limiting member as described herein can be optimized for a particular swing speed, including lower swing speeds. As described above, many existing golf club heads are optimized for swing speeds that are higher than typical swing speeds for older and/or less experienced golfers. A golf club head as described herein, including a deformation limiting member, can provide improved performance at lower swing speeds, allowing players having low swing speeds to achieve greater ball speeds, while not impeding the ball speed achieved at higher swing speeds. Still other benefits and advantages are readily recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face having a ball striking surface adapted to impact a golf ball and an inner surface opposite the ball striking surface;

a body connected to the face and extending rearward from the face, wherein the face and the body define an interior cavity and an inner surface of the body surrounding the interior cavity; and a deformation limiting member located behind the face and having a fixed end connected to the inner surface of the body spaced a first rearward distance from a peripheral edge of the face and a free end spaced a second rearward distance from the inner surface of the face, wherein a gap is formed between the deformation limiting member and the inner surface of the face, and wherein the first rearward distance is greater than the second rearward distance such that the gap is greater at the fixed end than at the free end, wherein the deformation limiting member comprises a flange extending from the fixed end at the inner surface of the body toward the inner surface of the face and extending inward into the interior cavity, wherein the face and the deformation limiting member are adapted such that an impact of the golf ball on the ball striking surface causes deformation of the face toward the deformation limiting member, and wherein when the deformation of the face is sufficient to cause the inner surface of the face to engage the free end of the deformation limiting member, the deformation limiting member exerts a force on the face to resist further deformation of the face;

wherein the flange forms an inner edge at the free end, wherein the inner edge forms an elliptical shape.

2. The golf club head of claim 1, wherein the face comprises a face plate connected to a body member forming the body, the body member having a mounting portion, wherein the face plate is connected to the mounting portion.

3. The golf club head of claim 2, wherein the body member has an opening at a front end thereof, and the mounting portion is positioned around at least a portion of the opening and forms a recessed platform around at least a portion of the opening, and a peripheral edge of the face plate contacts the recessed platform to connect the face plate to the mounting portion.

4. The golf club head of claim 2, wherein the fixed end of the deformation limiting member is connected to the mounting portion.

5. The golf club head of claim 4, wherein the mounting portion is connected to the face plate at top and bottom sides of the face plate, and wherein a first portion of the deformation limiting member extends from the mounting portion at the top side and a second portion of the deformation limiting member extends from the mounting portion at the bottom side.

6. A golf club comprising the golf club head of claim 1 and a shaft connected to the golf club head.

7. A golf club head comprising:

a face having a ball striking surface adapted to impact a golf ball and an inner surface opposite the ball striking surface, the face being defined by a plurality of peripheral edges;

a body connected to the face and extending rearward from the face, wherein the face and the body define an interior cavity and an interior surface surrounding the interior cavity and further define a volume of at least 400 cc; and a deformation limiting member located behind the face and having a first portion extending toward an inner surface of the face and extending toward the interior cavity from a fixed end at the interior surface spaced a first rearward distance from a first of the peripheral edges of the face and a second portion extending toward the inner surface of the face and extending toward the interior cavity from a fixed end at the interior surface spaced a second rearward distance from a second of the peripheral edges of the face, the first and second portions each having a free end spaced a third rearward distance from the inner surface of the face, wherein a gap is formed between the deformation limiting member and the inner surface of the face, and wherein the first rearward distance and the second rearward distance are greater than the third rearward distance such that the gap is greater at the fixed end than at the free end;

wherein the face and the deformation limiting member are adapted such that an impact of the golf ball on the ball striking surface causes deformation of the face toward the free ends of the first and second portions of the deformation limiting member, and wherein when the deformation of the face is sufficient to cause the inner surface of the face to engage at least one of the free ends of the deformation limiting member, the deformation limiting member exerts a force on the face to resist further deformation of the face; and wherein the first portion of the deformation limiting member comprises a flange extending from a top side of the interior surface and the second portion of the deformation limiting member comprises a flange extending from a bottom side of the interior surface, wherein the first portion and the second portion of the deformation limiting member each extend from a toe side of the body to a heel side of the body, and wherein the first portion and the second portion are separate members.

8. The golf club head of claim 7, wherein the face comprises a face plate connected to a body member forming the body, the body member having a mounting portion, wherein the face plate is connected to the mounting portion, and wherein at least one of the first and second portions of the deformation limiting member has the fixed end connected to the mounting portion.

9. The golf club head of claim 8, wherein the body member has an opening at a front end thereof, and the mounting portion is positioned around at least a portion of the opening and forms a recessed platform around at least a portion of the opening, and a peripheral edge of the face plate contacts the recessed platform to connect the face plate to the mounting portion.

10. The golf club head of claim 8, wherein both the first and second portions of the deformation limiting member have the fixed end connected to the mounting portion.

11. The golf club head of claim 8, wherein the mounting portion is connected to the face plate at top and bottom sides of the face plate, and wherein the first portion of the deformation limiting member extends inwardly from the mounting portion at the top side toward the interior cavity and the second portion of the deformation limiting member extends inwardly from the mounting portion at the bottom side toward the interior cavity.

12. The golf club head of claim 7, wherein the face comprises a face plate connected to a body member forming the body, the body member having an opening receiving the face plate therein, and wherein the deformation limiting member comprises a flange extending inwardly from the interior surface on the body member around at least a portion of the opening, with the flange forming the first and second portions of the deformation limiting member.

13. A golf club comprising the golf club head of claim 7 and a shaft connected to the golf club head.

14. A golf club head comprising:

a face member forming a face having a ball striking surface adapted to impact a golf ball and an inner surface opposite the ball striking surface;

a body member connected to the face member, wherein the face member and the body member define an interior cavity and an inner surface surrounding the interior cavity, the body member having a front end with an opening receiving the face member therein and a rear end extending rearwardly from the front end to form a body extending rearward from the face; and a deformation limiting member comprises a flange having a fixed end spaced a first rearward distance from the inner surface of the face that is connected to the inner surface of the body, the deformation limiting member extending toward the inner surface of the face and inwardly toward the interior cavity from the fixed end at the inner surface of the body member and having a free end spaced a second rearward distance from the inner surface of the face, wherein a gap is formed between the deformation limiting member and the inner surface of the face, and wherein the first rearward distance is greater than the second rearward distance such that the gap is greater at the fixed end than at the free end;

wherein the face member and the deformation limiting member are adapted such that an impact of the golf ball on the ball striking surface causes deformation of the face toward the deformation limiting member, and wherein when the deformation of the face is sufficient to cause the inner surface of the face to engage the free end of the deformation limiting member, the deformation limiting member exerts a force on the face to resist further deformation of the face, and wherein the flange forms an inner edge at the free end, wherein the inner edge forms an elliptical shape.

15. The golf club head of claim 14, wherein the body member has a mounting portion positioned around at least a portion of the opening, wherein the face member is connected to the mounting portion.

16. The golf club head of claim 15, wherein the mounting portion forms a recessed platform around at least a portion of the opening, and a peripheral edge of the face member contacts the recessed platform to connect the face member to the mounting portion.

17. The golf club head of claim 15, wherein the fixed end of the deformation limiting member is connected to the mounting portion and the deformation limiting member extends from the fixed end at the mounting portion toward the inner surface of the face.

18. The golf club head of claim 17, wherein the mounting portion is connected to the face member at top and bottom sides of the face member, and wherein a first portion of the deformation limiting member extends from the mounting portion at the top side and a second portion of the deformation limiting member extends from the mounting portion at the bottom side.

19. A golf club comprising the golf club head of claim 14 and a shaft connected to the golf club head.

20. A golf club head comprising:

a face member forming a face having a ball striking surface adapted to impact a golf ball and an inner surface opposite the ball striking surface, the face member being defined by peripheral edges;

a body member connected to the face member, the body member having a front end with an opening receiving the face member therein and a rear end extending rearwardly from the front end to form a body extending rearward from the face, wherein the face member and the body member define an interior cavity and an interior surface surrounding the interior cavity and define a volume of at least 400 cc, the body member further having a mounting portion forming a platform around at least a portion of the opening, wherein the platform is recessed from the front end of the body member and the peripheral edges of the face member contact the platform to connect the face member to the mounting portion; and a deformation limiting member comprising a flange having a fixed end spaced a first rearward distance from the peripheral edges of the face member and connected to the mounting portion, wherein the deformation limiting member extends toward the inner surface of the face and extends from the mounting portion inward toward the interior cavity and has a free end spaced a second rearward distance from the inner surface of the face, wherein a gap is formed between the deformation limiting member and the inner surface of the face, and wherein the first rearward distance is greater than the second rearward distance such that the gap is greater at the fixed end than at the free end;

wherein the face member and the deformation limiting member are adapted such that an impact of the golf ball on the ball striking surface causes deformation of the face toward the deformation limiting member, and wherein when the deformation of the face is sufficient to cause the inner surface of the face to engage the free end of the deformation limiting member, the deformation limiting member exerts a force on the face to resist further deformation of the face, and wherein deformation limiting member comprises a first portion extending from a top side of the mounting portion and a second portion extending from a bottom side of the mounting portion, wherein the first portion and the second portion of the deformation limiting member extend from a toe side of the body to a heel side of the body, and wherein the first portion and the second portion are separate members.

21. The golf club head of claim 20, wherein the mounting portion is connected to the face member at top and bottom sides of the face member.

22. A golf club comprising the golf club head of claim 20 and a shaft connected to the golf club head.

* * * * *